US008006333B2

(12) United States Patent
Genaro et al.

(10) Patent No.: US 8,006,333 B2
(45) Date of Patent: Aug. 30, 2011

(54) PATIENT SUPPORT SURFACE WITH TURN-ASSIST

(75) Inventors: David Genaro, North Lauderdale, FL (US); Lydia Biggie, Lighthouse Point, FL (US)

(73) Assignee: Stryker Corporation, Kalamazoo, MI (US)

( * ) Notice: Subject to any disclaimer, the term of this patent is extended or adjusted under 35 U.S.C. 154(b) by 462 days.

(21) Appl. No.: 11/940,995

(22) Filed: Nov. 15, 2007

(65) Prior Publication Data

US 2008/0120780 A1 May 29, 2008

Related U.S. Application Data

(60) Provisional application No. 60/866,206, filed on Nov. 16, 2006.

(51) Int. Cl.
*A47C 27/10* (2006.01)

(52) U.S. Cl. ..... 5/615; 5/715; 5/722; 5/723; 5/710

(58) Field of Classification Search ..... 5/713, 600, 5/618, 615, 714, 706, 708, 709, 710, 715, 5/722–723

See application file for complete search history.

(56) References Cited

U.S. PATENT DOCUMENTS

| | | | | |
|---|---|---|---|---|
| 4,991,244 | A | 2/1991 | Walker | |
| 5,179,742 | A | 1/1993 | Oberle | |
| 5,267,364 | A | 12/1993 | Volk | |
| 5,325,551 | A | 7/1994 | Tappel et al. | |
| 5,421,044 | A | 6/1995 | Steensen | |
| 5,483,709 | A | 1/1996 | Foster et al. | |
| 5,594,963 | A | 1/1997 | Berkowitz | |
| 5,634,225 | A | 6/1997 | Miller, Sr. et al. | |
| 5,794,289 | A | 8/1998 | Wortman et al. | |
| 5,802,646 | A | 9/1998 | Stolpmann et al. | |
| 5,956,787 | A | 9/1999 | James et al. | |
| 6,079,070 | A | 6/2000 | Flick | |
| 6,282,735 | B1 * | 9/2001 | Stolpmann et al. | 5/713 |
| 6,286,167 | B1 | 9/2001 | Stolpmann | |
| 6,430,766 | B1 | 8/2002 | Henley et al. | |
| 6,447,865 | B1 | 9/2002 | Flick et al. | |
| 6,467,113 | B2 * | 10/2002 | Ellis et al. | 5/713 |
| 6,568,013 | B2 | 5/2003 | Perez et al. | |
| 6,684,434 | B2 * | 2/2004 | Ellis et al. | 5/713 |
| 6,892,405 | B1 * | 5/2005 | Dimitriu et al. | 5/713 |

* cited by examiner

*Primary Examiner* — Robert G Santos
*Assistant Examiner* — Brittany M Wilson
(74) *Attorney, Agent, or Firm* — Warner Norcross & Judd LLP

(57) ABSTRACT

A patient support apparatus includes a support surface, with at least one fluid bladder, a base wall, and a cradle, and a fluid delivery system configured to deliver fluid to the bladder. The cradle is formed from a compressible material and is supported by the base wall, with the bladder being anchored at the base wall.

24 Claims, 25 Drawing Sheets

PATIENT SUPPORT SURFACE WITH TURN-ASSIST

This application claims the benefit of provisional application, entitled A PATIENT LYING SURFACE WITH TURN-ASSIST, Ser. No. 60/866,206, filed Nov. 16, 2006.

TECHNICAL FIELD AND BACKGROUND OF THE INVENTION

The present invention relates to a mattress assembly for use on a hospital bed. More particularly, the present invention relates to a replacement mattress assembly that can be used on various types of bed frames to provide improved patient support and therapies.

SUMMARY OF THE INVENTION

A patient support apparatus is provided that includes a support surface with at least one fluid bladder and a fluid delivery system configured to deliver fluid to the bladder. The patient support apparatus further includes a base wall and a cradle, with the cradle formed from a compressible material and having a compressible lower wall supported by the base wall. The bladder includes one or more tethers that are trapped between the compressible lower wall of the cradle and the base wall to thereby stabilize the bladder.

In one aspect, the tether comprises a strap. For example, the strap may extend through the cradle.

In a further aspect, the support surface includes a plurality of bladders, with a first group of the bladders arranged longitudinally along the cradle and a second group of the bladders arranged transversely along the cradle. In addition, each of the groups of bladders may be stabilized using the same tether or different tethers.

In yet further aspects, a third group of the bladders is arranged longitudinally along the cradle beneath the second group of bladders, which may comprise turning bladders. Further, the turning bladders may also be stabilized using the same tether or another tether and optionally also with the tether trapped between the compressible lower wall of the cradle and the base wall.

For example, the tether or tethers may each include an anchor that is trapped between the compressible lower wall of the cradle and the base wall.

In another form of the invention, a patient support apparatus includes a support surface with a plurality of fluid bladders and a base wall. Positioned between the base wall and the bladders is a compressible member. The bladders are in a stacked arrangement on the compressible member, with the bladders having at least one anchor that is trapped between the compressible member and the base wall to thereby stabilize the bladders. The apparatus further includes a fluid delivery system with a pump configured to deliver fluid to the bladders, with at least a portion of the fluid delivery system being located in the support surface.

In one aspect, the support surface further includes a cradle formed from a compressible material, with the cradle including the compressible member and the bladders supported in the cradle. For example, the cradle may comprise a foam cradle.

In a further aspect, the bladders include at least one tether, which is coupled to the anchor. For example, the tether may comprise a strap which is coupled to or forms the anchor. In a further aspect, the tether extends through the cradle.

In other aspects, a first group of the bladders is arranged longitudinally along the base wall, with a second group of the bladders being arranged generally orthogonal to the first group of bladders transversely along the base wall. Further, each group of bladders is stabilized by the same anchor by another anchor or anchors.

In another aspect, the base wall includes a recess, with at least a portion of the fluid delivery system being located in the recess.

According to yet a further aspect, at least a portion of the fluid delivery system is secured in the recess by a strap.

In yet another form of the invention, a patient support apparatus includes an enclosure, at least one inflatable bladder supported in the enclosure, an inflation device for inflating the bladder, and a chamber in fluid communication with the bladder. The chamber is also enclosed in the enclosure and has a valve. A pull tab is located in an opening in the side of the enclosure, which includes a portion that extends into the valve for selectively opening the valve to release fluid from the chamber wherein the fluid in the inflatable bladder is released through the chamber and through the cradle to thereby quickly deflate the bladder.

In one aspect, the apparatus includes a plurality of bladders, with the chamber comprising a manifold having a plurality of conduits coupled to the bladders.

According to yet another form of the invention, a patient support apparatus includes a surface with at least one inflatable bladder, an inflation device for inflating the inflatable bladder, a controller for controlling the inflation device, and a chamber in fluid communication with the bladder. The chamber has a valve, with the controller selectively opening the valve to release fluid from the chamber wherein the fluid in the inflatable bladder is released through the chamber to thereby quickly deflate the bladder. Optionally, the control may be located in the surface.

Accordingly, the present invention provides a patient support apparatus that can be used on various types of bed frames to provide improved patient support and therapies.

These and other objects, advantages, purposes, and features of the invention will become more apparent from the study of the following description taken in conjunction with the drawings.

BRIEF DESCRIPTION OF DRAWINGS

The detailed description particularly refers to the accompanying figure in which.

DETAILED DESCRIPTION OF THE INVENTION

Definitions

The term "longitudinal" as used herein and unless defined otherwise is used to define a length-wise orientation, for example from one end to the other end of the patient lying surface along the length thereof.

The term "transverse" as used herein and unless defined otherwise is used to define an orientation generally perpendicular to a length-wise orientation, for example from side to side of the patient lying surface along the width thereof.

The term "head end" as used herein and unless defined otherwise is used in relative positioning to mean the end in proximity of the head of a patient lying on the lying surface.

The term "foot end" as used herein and unless defined otherwise is used in relative positioning to mean the end in proximity of the feet of a patient lying on the lying surface.

Figure 1A:
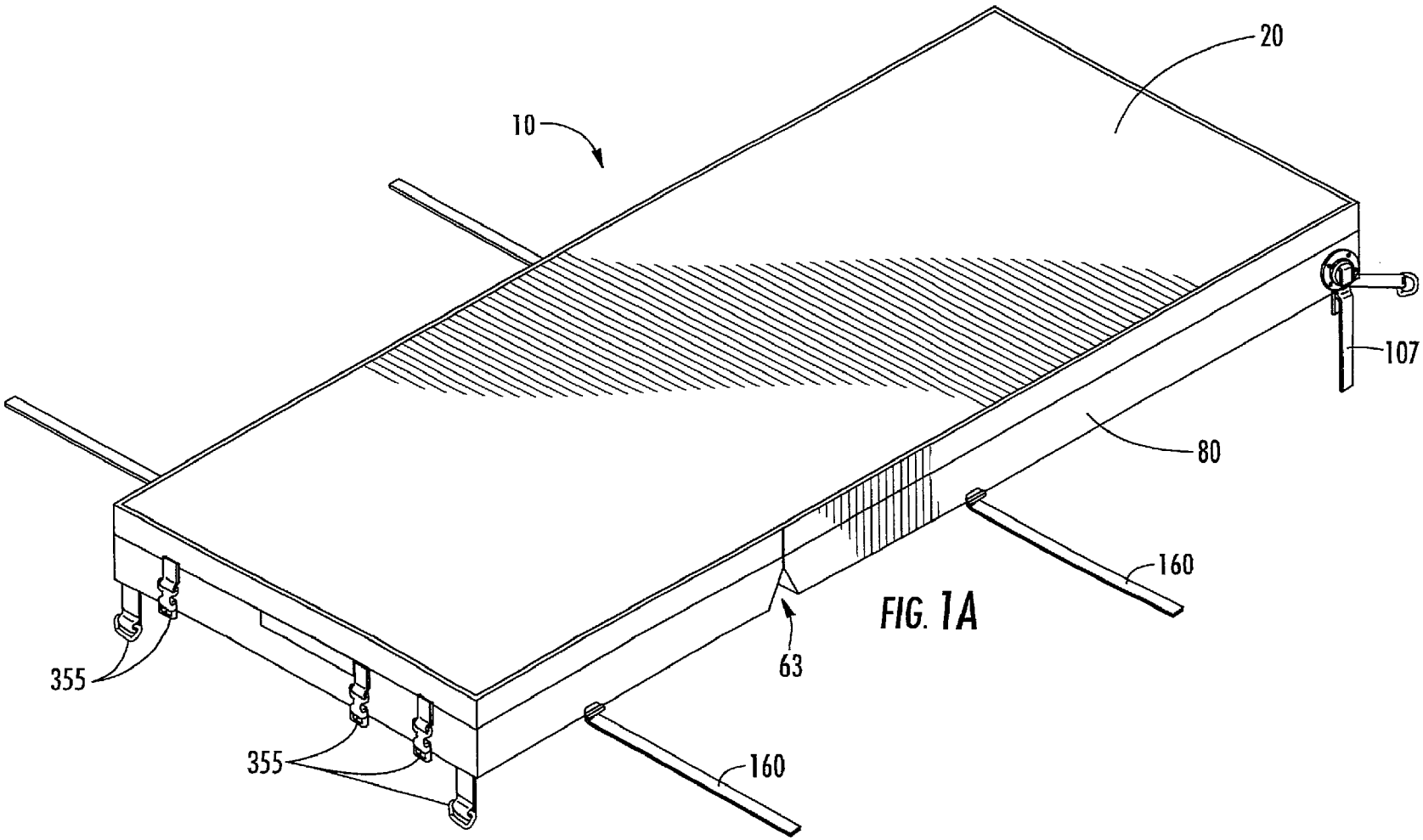
FIG. 1A is an isometric view of a patient lying surface according to one embodiment of the present invention.
Figure 1B:
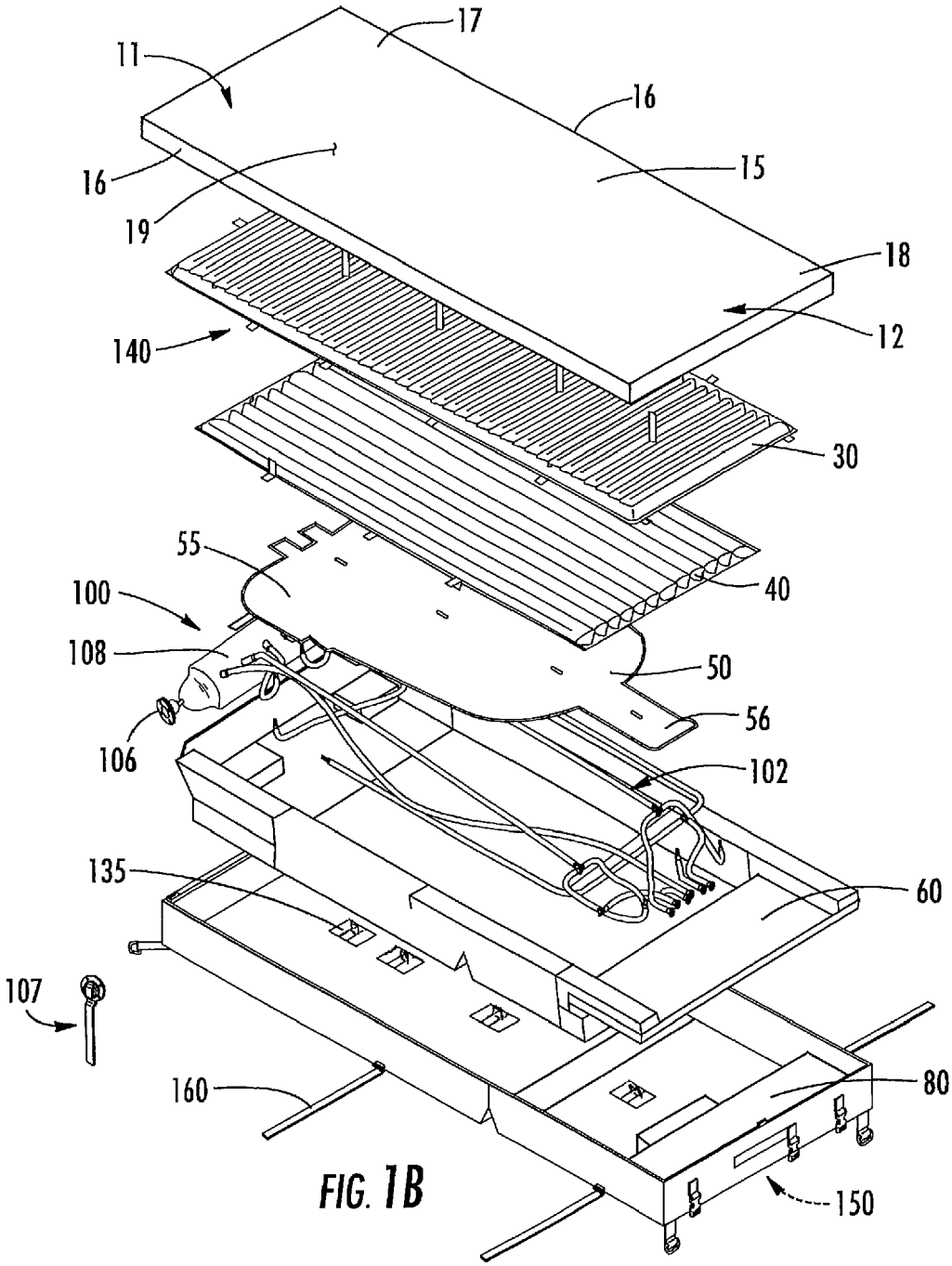
FIG. 1B is an isometric exploded view of a patient lying surface according to one embodiment of the present invention.

Referring to FIGS. 1A and 1B, the numeral 10 designates a patient support surface of a patient support apparatus, typically a bed or other patient handling devices, such as a cot, a stretcher, or the like. In the illustrated embodiment, patient support surface 10 includes a top cover 15, a plurality of bladders (30, 40, and 50), a crib 60, and a bottom cover 80. In the illustrated embodiment, three groups of bladders are provided, namely, an upper group of cushion bladders 30, a lower group of cushion bladders 40, and a group of turning bladders 50. The upper group of cushion bladders 30 includes a plurality of transverse bladders 32. Similarly, the lower group of cushion bladders 40 is made of a plurality of longitudinal bladders 42. Further, the group of turning bladders 50 is made up of at least two turning bladders 52, 54. To inflate the various bladders, patient support surface 10 includes an inflating/deflating system 100, which is at least partially embedded in the patient support surface.

Top Cover

Figure 2:
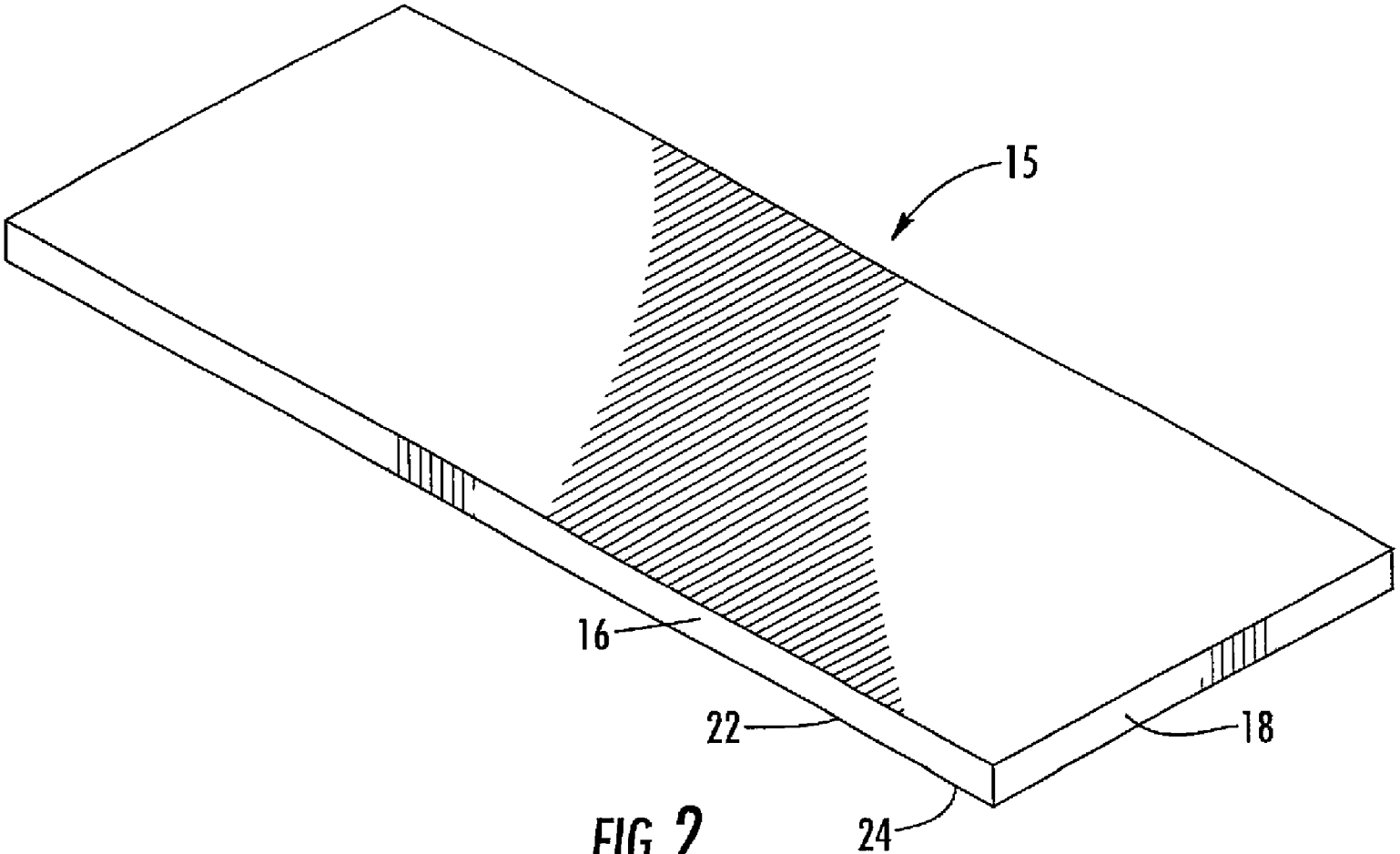
FIG. 2 is an isometric view of a top cover according to an embodiment of the present invention.

FIG. 2 illustrates a top cover 15 according to one embodiment of the present invention. The top cover 15 of the instant invention may fulfill several functional requirements. It is optionally easy to clean, it may help eliminate cross infections it may be impermeable, it is flexible and stretchable to accommodate various positions of the patient support surface 10, and it is soft and optionally fire retardant. Top cover 15 of the patient support surface, according to an embodiment of the present invention, comprises side portions 16, a head portion 17, a foot portion 18 and a top portion 19.

Figure 7A:
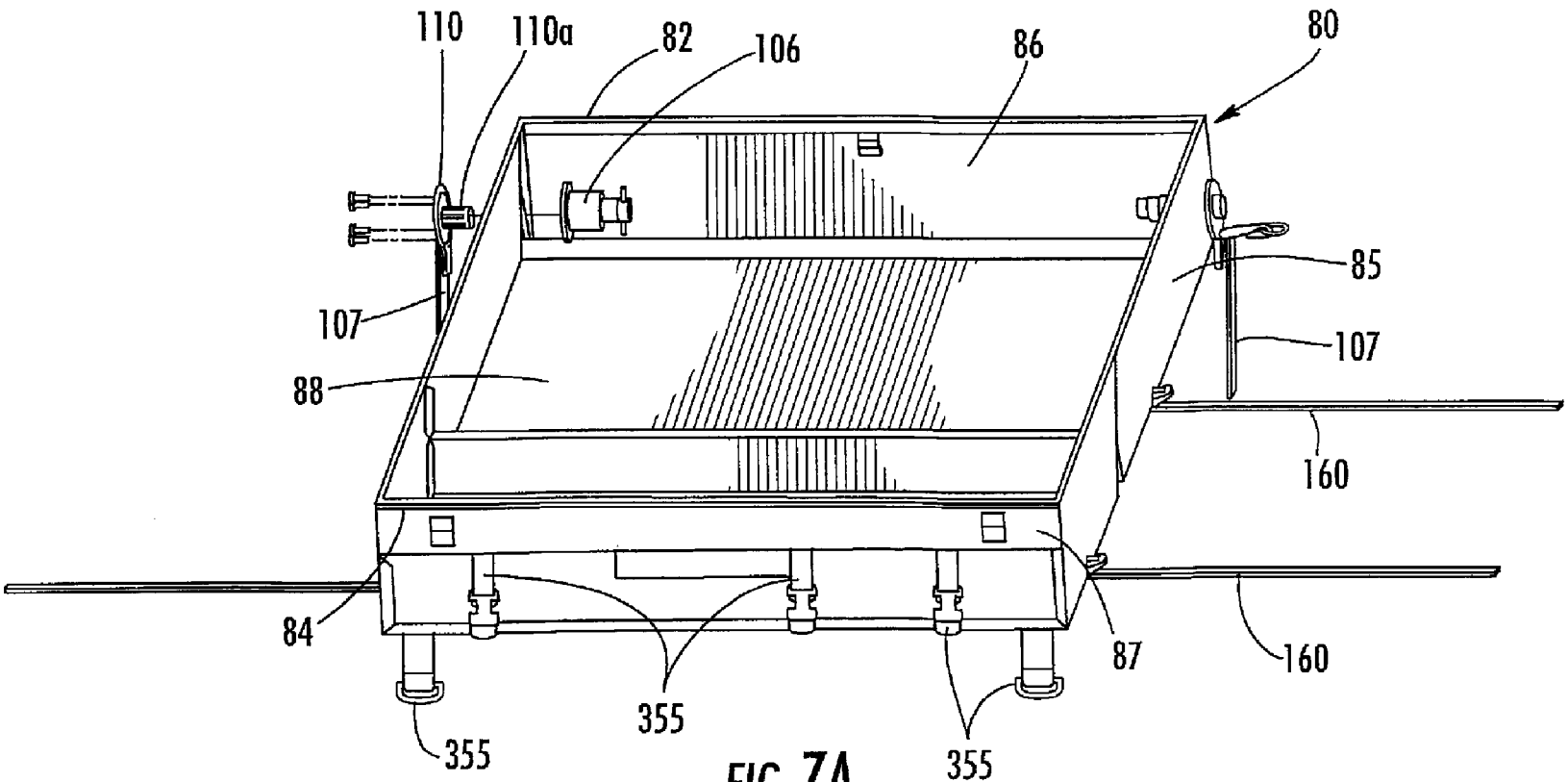
FIG. 7A is an isometric view of a bottom cover according to an embodiment of the present invention.

Referring to FIGS. 2 and 7A, the lower peripheral contour 22 of top cover 15 includes an attachment device or fastener designed to complementarily mate with an attachment device or fastener of upper peripheral contour 82 of bottom cover 80. When mated, the top cover 15 and bottom cover 80 completely encompass the upper group of cushion bladders 30, the lower group of cushion bladders 40, the turning bladder 50, the inflating/deflating system 100 (except the control box assembly 300 described more fully below), and the foam crib 60. Furthermore, attachment devices are hidden and not visible when properly mated to one another. In one embodiment of the present invention, this can be achieved through the use of an overlay (not shown), in the form of a large material flap, concealing mated attachment devices and stitches of top cover 15 and bottom cover 80. This latter feature may limit contamination, maintain fire retardant properties of the patient support surface 10 and minimize, if not eliminate, liquids from seeping into the patient support surface 10.

In one embodiment of the present invention, the attachment devices comprise a zipper. In alternative embodiments, and without limiting the scope of the invention, attachment devices may be configured as Velcro™ attachment, snaps, straps, and other know attachment means.

According to another embodiment of the present invention, an overlay is made of the same material as top cover 15 and is permanently affixed thereto. In another embodiment of the present invention, the overlay is permanently affixed to bottom cover 80.

The top cover 15, according to one embodiment of the present invention, may be made of premium polyurethanes material such as Dartex™ material, commercially available from Dartex Coatings Inc., Slatersville, R.I., under the name Dartex™ or any other suitable material that exhibits good hydrolysis properties, thus reducing, if not eliminating, potential risks from cross contamination. Further, the top cover 15 may meet International Flame Retardant Standard BS EN 531 and equivalents. In another embodiment of the present invention, the top cover 15 may be made of material that is air and moisture vapor impermeable as well as being fluid impermeable. In yet another embodiment, top cover 15 may be made of material which is biostatic (anti-mycotic) providing a barrier to virus and bacteria.

A worker skilled in the art would readily understand that, without limitations, urethane based materials, such as nylon-based fabric with a polyurethane transfer coating, or vinyl based or vinyl coated materials, or polyvinyl chloride (PVC) or polyolefin laminated or coated fabrics or other heat sealable covering materials with antibacterial, antifungal and fluid penetration resistant characteristics may be used to make the top cover 15 without departing from the scope of the present invention.

In one embodiment of the present invention, there is a fire barrier layer adjoining the top cover 15, which may consist of a cloth. The fire barrier layer can be made of fire retardant or fire resistant materials. Examples of suitable materials for a fire barrier layer, without limitations, are Nomex™ (a meta-aramid material) and Keylar™ commercially available from DuPont & Company, Wilmington, Del., M5 fiber commercially available from Magellan Systems International, LLC, Bethesda, Md., coated nylon, carbon foam, Proban™ and Indura™ FR cotton fabrics commercially available from Westex Inc., Chicago, Ill., Pyrovatex™ FR cotton commercially available from CIBA Specialty Chemicals Corporation, Tarrytown, N.Y., Dale Antiflame™ cotton fabric commercially available from Daletec AS, Dalekvam, Norway, Technora™ fabric commercially available from Teijin Kabushiki Kaisha Corporation, Japan, Lenzing FR™ commercially available from Lenzing Fibers Inc., North Axis, Ala., modacrylic fiber, poluamide-imide fibers and polybenzimidazole (PBI) fibers.

In one embodiment of the present invention, the fire barrier layer is contiguous with top cover 15 to form a coverlet. The coverlet performs the same functions as the top cover 15 described above but further comprises a fire barrier layer for added fire retardant or fire resistant characteristics.

According to one embodiment of the present invention, the fire barrier layer and top cover 15 are fused together. Alternately, the fire barrier layer and top cover 15 may be operatively connected together, for example by stitches, snaps, eyelets, hooks, laces, Velcro™ attachments.

The Upper Group of Cushion Bladders

Figure 3A:
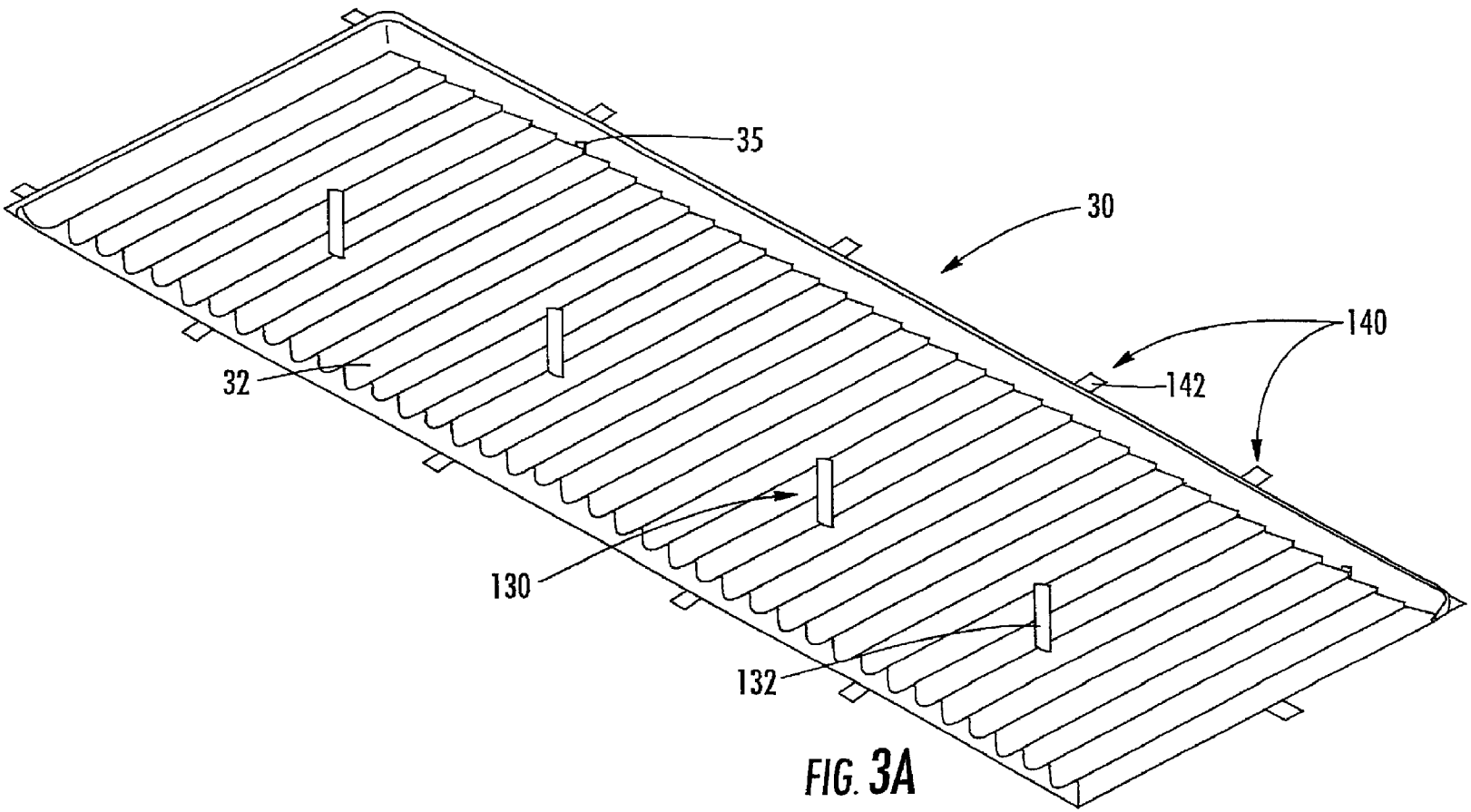
FIG. 3A is a bottom isometric view of a first group of upper cushion bladders according to an embodiment of the present invention.
Figure 3B:
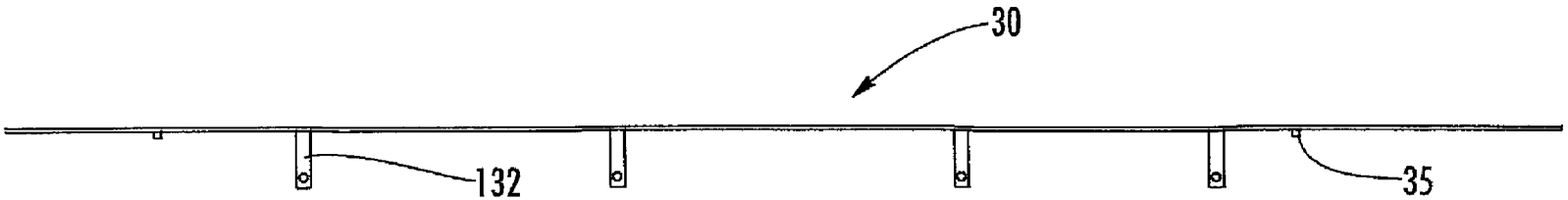
FIG. 3B is a transverse side view of a deflated first group of upper cushion bladders according to an embodiment of the present invention.
Figure 3C:
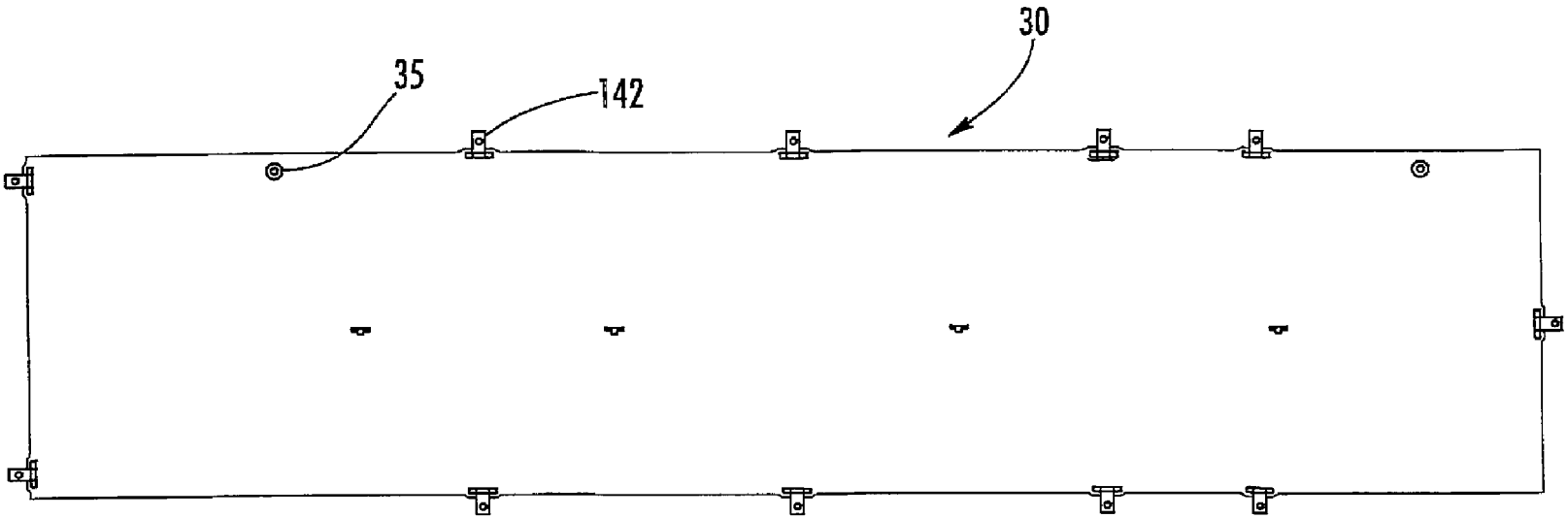
FIG. 3C is a top view of a first group of upper cushion bladders according to an embodiment of the present invention.

With reference to FIGS. 3A, 3B and 3C, the upper group of cushion bladders 30 may be made of a plurality of substantially parallel transverse (running across the width) bladders 32 to provide transverse cushioning and support for the patient's body. The upper group of cushion bladders 30 may adjoin and be interposed between top cover 15 (or coverlet) and lower group of cushion bladders 40 (FIG. 1B). Bladders 32 are inflatable and deflatable to adjust the cushioning effect and firmness of the upper group of cushion bladders 30 to a desired or required level. Alternately, each bladder 32 is individually inflatable and deflatable. Generally, when patient support surface 10 is in use, upper group of cushion bladders 30 is inflated and can be adjusted to desired firmness depending on the needs of the patient. The relatively narrow width or diameter of bladders 32 may be designed to provide for better body pressure redistribution and to provide full body pressure relief to the patient lying on the patient support surface 10.

Upper group of cushion bladders 30 may be slightly wider than the lower group of cushion bladders 40 and the turning bladder 50. The upper group of cushion bladders 30 covers the control box assembly enclosure 150 and CPR manifold enclosure 109 located at the foot end 12 and head end 11 of the patient support surface respectively.

According to another embodiment of the present invention, parallel bladders 32 are substantially parallel and longitudinally running across the length of upper group of cushion bladders 30, providing longitudinal cushioning and support for the patient's body. Further, upper group of cushion bladders 30 is held in place by a bladder anchoring system 130, fully described further in this specification.

Optionally, all bladders 32 may be independent of each other and can be replaced separately if damaged.

Alternately, the upper group of cushion bladders 30 may be held in place by a bladder anchoring system 130 and a bladder securing means 140.

In another embodiment, in addition to a bladder anchoring system 140, a bladder securing means 140 may include a plurality of bladder securing straps 142 attached, and optionally permanently attached, to the sides of the upper group of cushion bladders 30, which are configured to be fastened to a plurality of bladder securing straps 143 and 144 (see FIGS. 4A and 5 respectively) that are attached, for example permanently attached, to the sides of lower group of cushion bladder 40 (FIG. 4A) and the sides of turning bladders 50 (FIG. 5), respectively.

In one embodiment, bladders 32 may be grouped into different sections of the upper group of cushion bladders 30, with each particular section being individually inflatable and deflatable and with all the bladders 32 from a particular group being inflatable or deflatable simultaneously. In this latter embodiment, the different sections may be designed to support a different part of the patient's body. Examples of such sections are, without limitations, a head section, a seat section, a thigh section, and a foot section, etc.

In one embodiment of the present invention, upper group of cushion bladders 30 is coupled to top cover 15 (or a coverlet where applicable) and to bottom cover 80 via a bladder anchoring system 130 as will be more fully described below. Alternately, upper group of cushion bladders 30 may be not affixed to top cover 15 (or to a coverlet).

Without departing from the intended scope of the present invention, a worker skilled in the art would understand that the number and shape of bladders 32, and of upper group of cushion bladders 30, can be varied in order to adapt patient support surface 10 to a variety of patient support apparatuses or to provide different care and treatments to patients having particular needs.

The Lower Group of Cushion Bladders

Figure 4A:
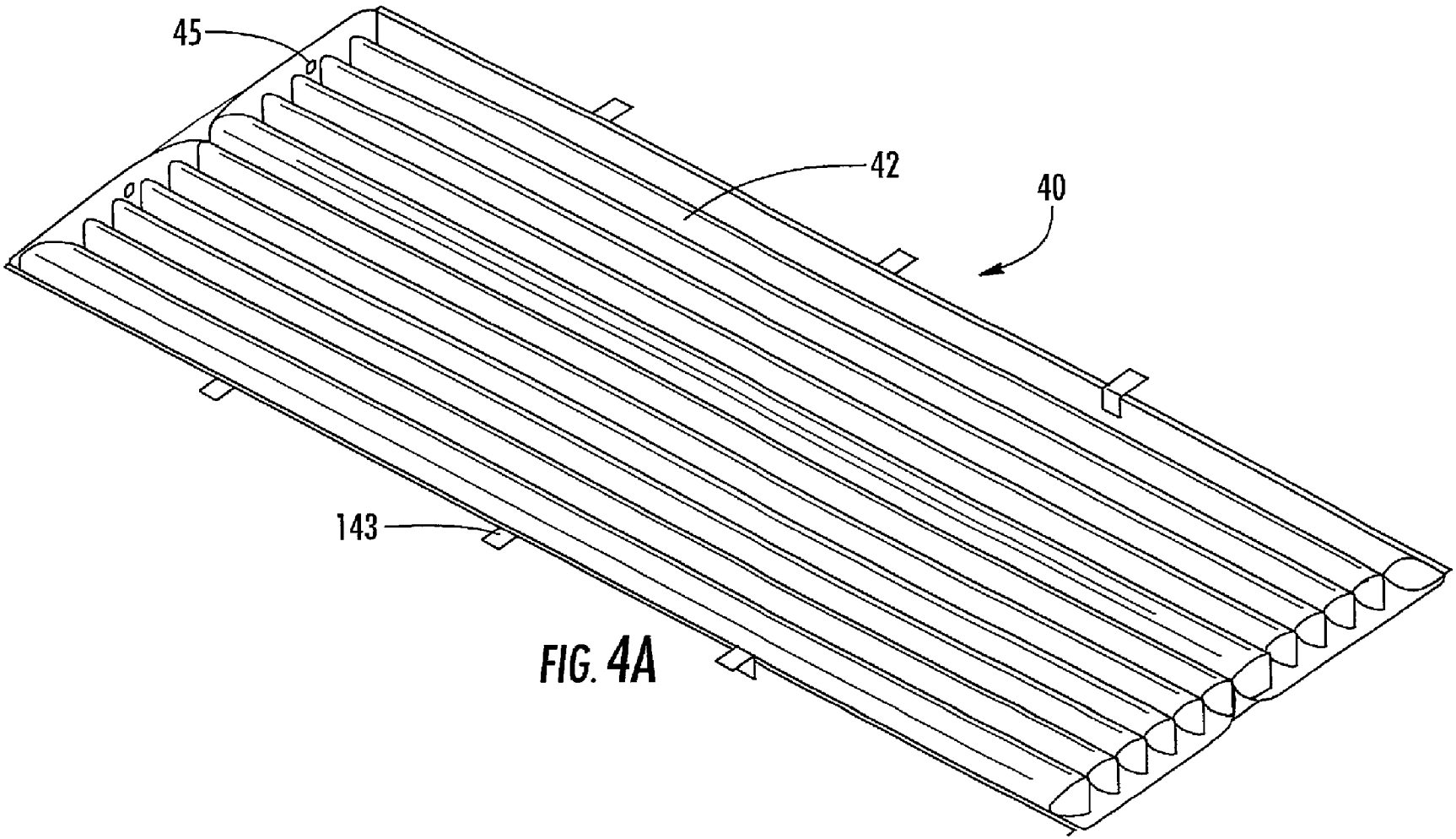
FIG. 4A is an isometric view of a lower group of cushion bladders according to an embodiment of the present invention.
Figure 4B:
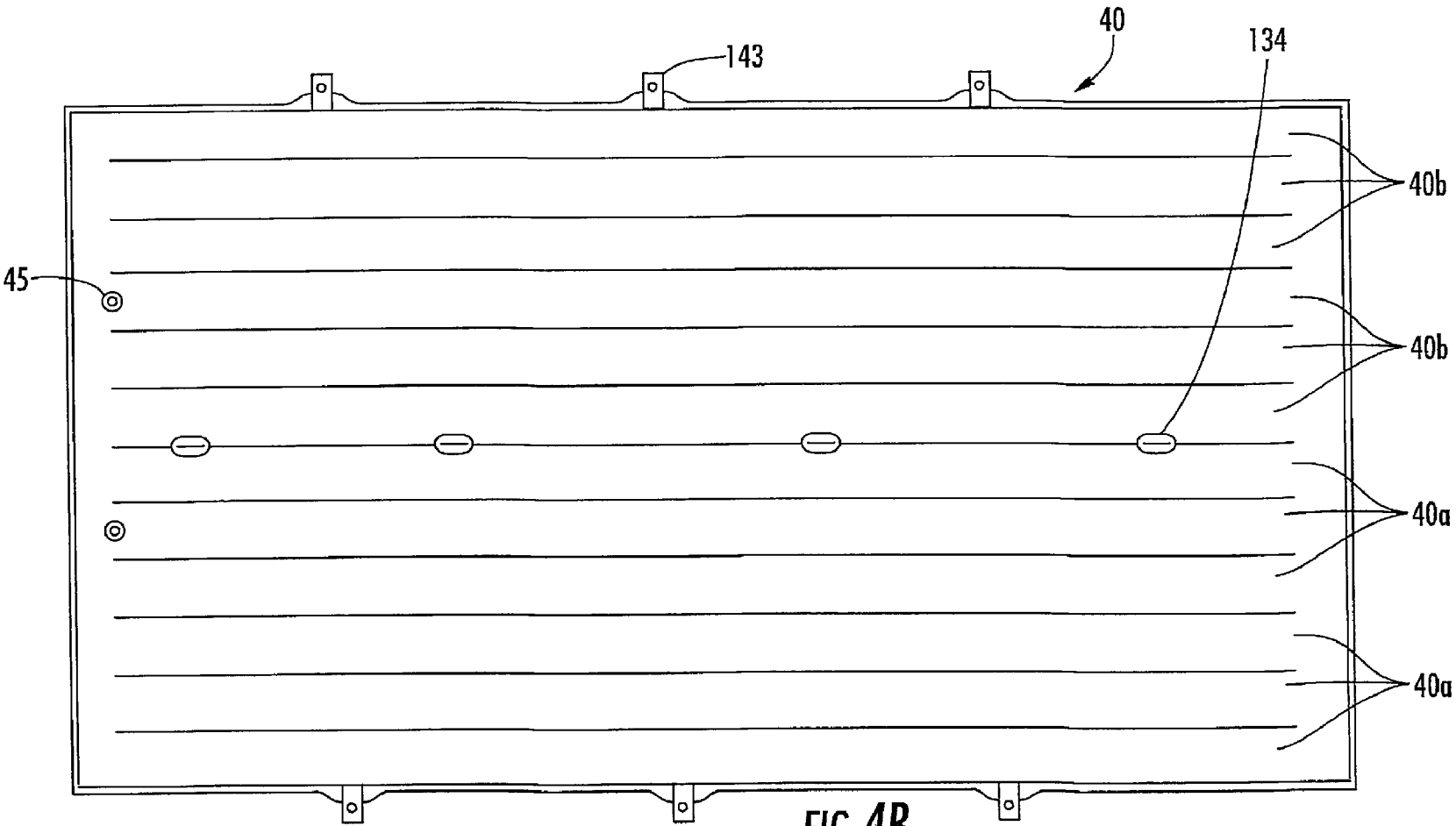
FIG. 4B is a top view of the lower group of cushion bladders according to the embodiment of the present invention depicted in FIG. 4A.

With reference to FIGS. 4A and 4B, lower group of cushion bladders 40, which may be formed from a plurality of parallel longitudinal bladders 42, provides longitudinal cushioning and support for the patient's body. Lower group of cushion bladders 40 may adjoin and be interposed between the upper group of cushion bladders 30 and the turning bladders 50. Each bladder 42 is inflatable and deflatable to adjust the cushioning effect and firmness of the lower group of cushion bladders 40 to a desired level, thus optionally providing full body pressure relief to the patient support on the patient support surface 10.

According to another embodiment of the present invention, parallel bladders 42 are substantially parallel and transverse, running across the width of lower group of cushion bladders 40 and providing transverse cushioning and support for the patient's body.

In one embodiment, each bladder 42 is individually inflatable and deflatable. In another embodiment, bladders 42 are grouped into different sections of the lower group of cushion bladders 40, and each particular section is individually inflatable and deflatable, all the bladders from that particular group being inflated or deflated simultaneously.

In one embodiment of the present invention, the lower group of cushion bladders 40 is held in place by a bladder anchoring system 130. Alternately, the lower group of cushion bladders 40 is held in place by both a bladder anchoring system 130 and bladder securing means 140. Lower group of cushion bladders 40 may be affixed to top cover 15 (or a coverlet) and to bottom cover 80 through bladder anchoring system 130 (see below).

In another embodiment of the present invention encompassing a bladder securing means 140 and depicted in FIGS. 4A and 4B, the bladder securing means 140 may be comprised of a plurality of bladder securing straps 143 permanently attached to the sides of lower group of cushion bladders 40 designed to be fastened to a plurality of bladder securing straps 142 and 144 (see FIGS. 3A and 5 respectively) permanently attached to the sides of upper group of cushion bladders 30 and the sides of turning bladders 50 respectively.

In one embodiment of the present invention, lower group of cushion bladders 40 may be affixed to top cover 15 (or a coverlet where applicable) and to bottom cover 80 through a bladder anchoring system 130 (see below).

In another embodiment of the present invention, lower group of cushion bladders 40 is not affixed to top cover 15 (or to a coverlet where applicable).

Without departing from the intended scope of the present invention, a worker skilled in the art would understand that the number and shape of bladders 42 and of lower group of cushion bladders 40 can be varied in order to accommodate the adaptation of patient support surface 10 to a variety of patient support apparatuses or to provide different care and treatments to a class of patients.

The Turning Bladder

Figure 5:
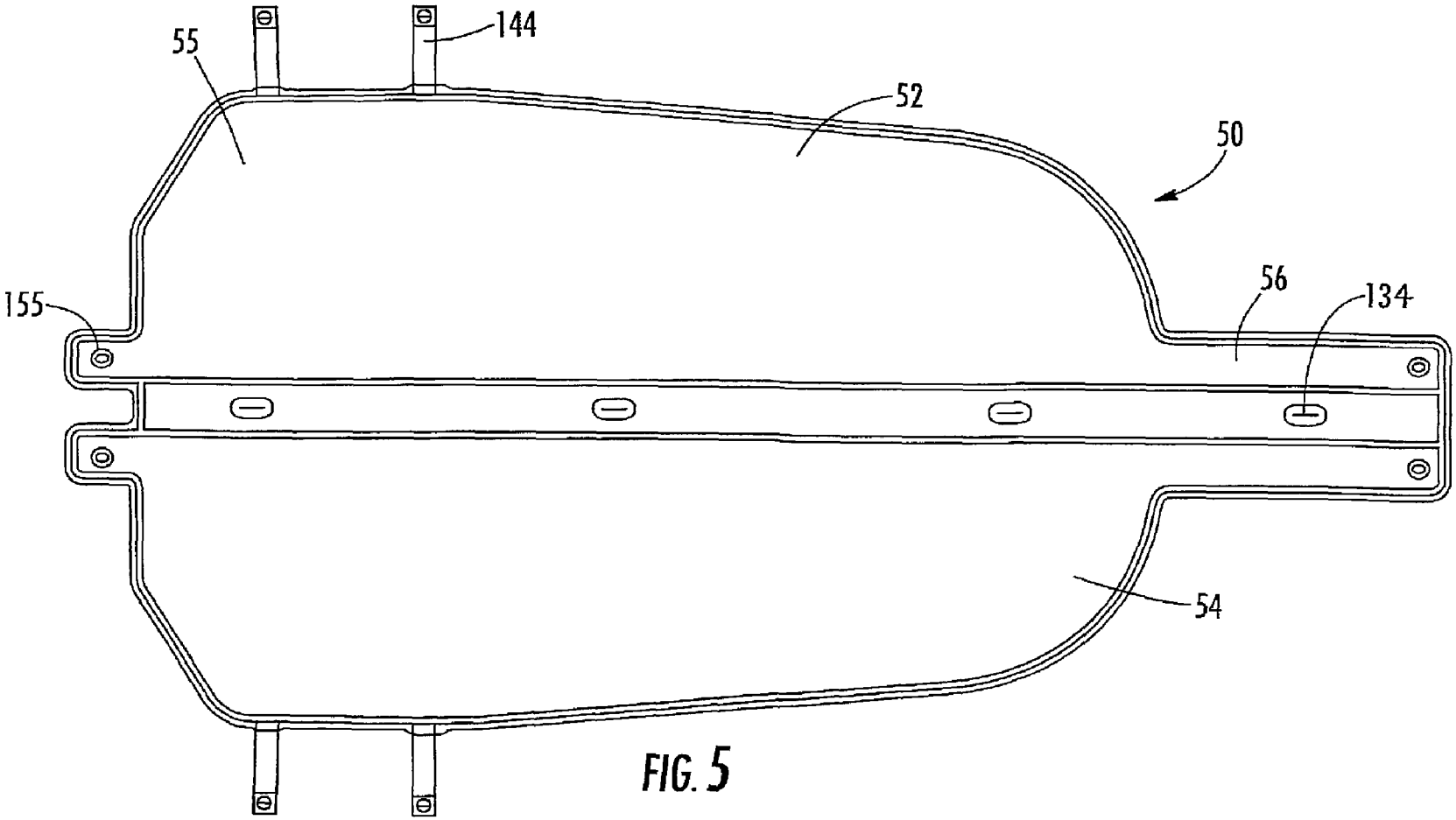
FIG. 5 is a top view of a turning bladder according to an embodiment of the present invention.
Figure 8:
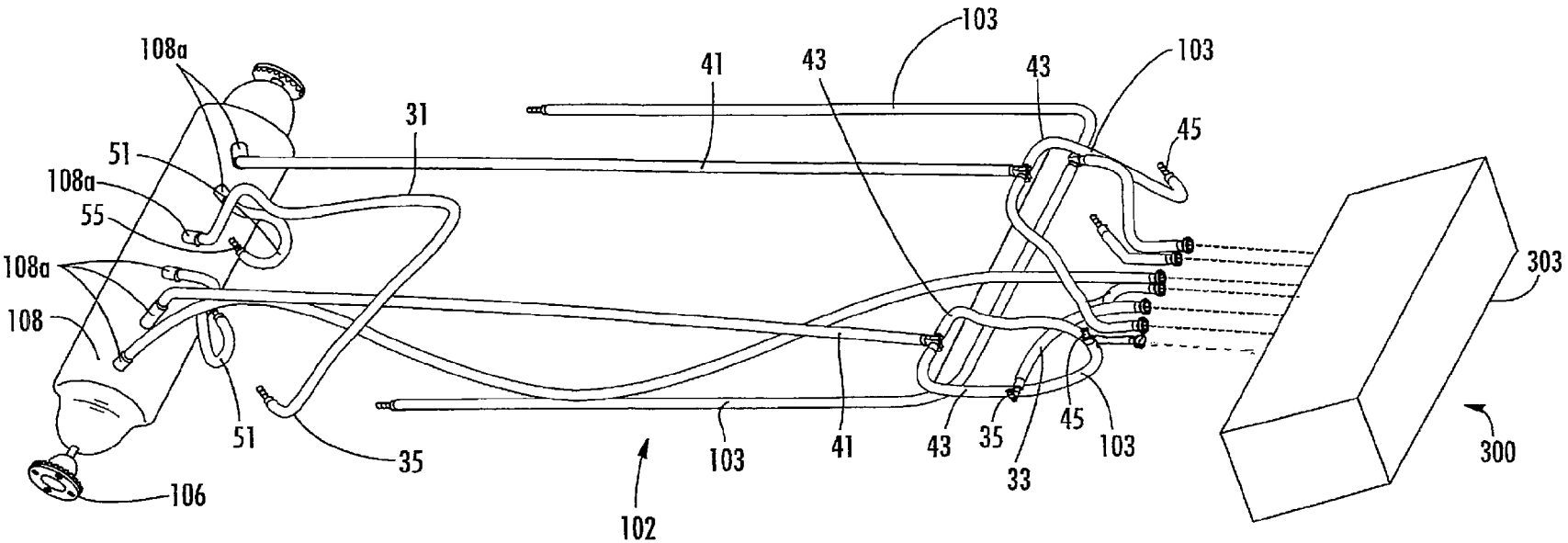
FIG. 8 is an isometric view of an inflating/deflating system according to an embodiment of the present invention.
Figure 12:
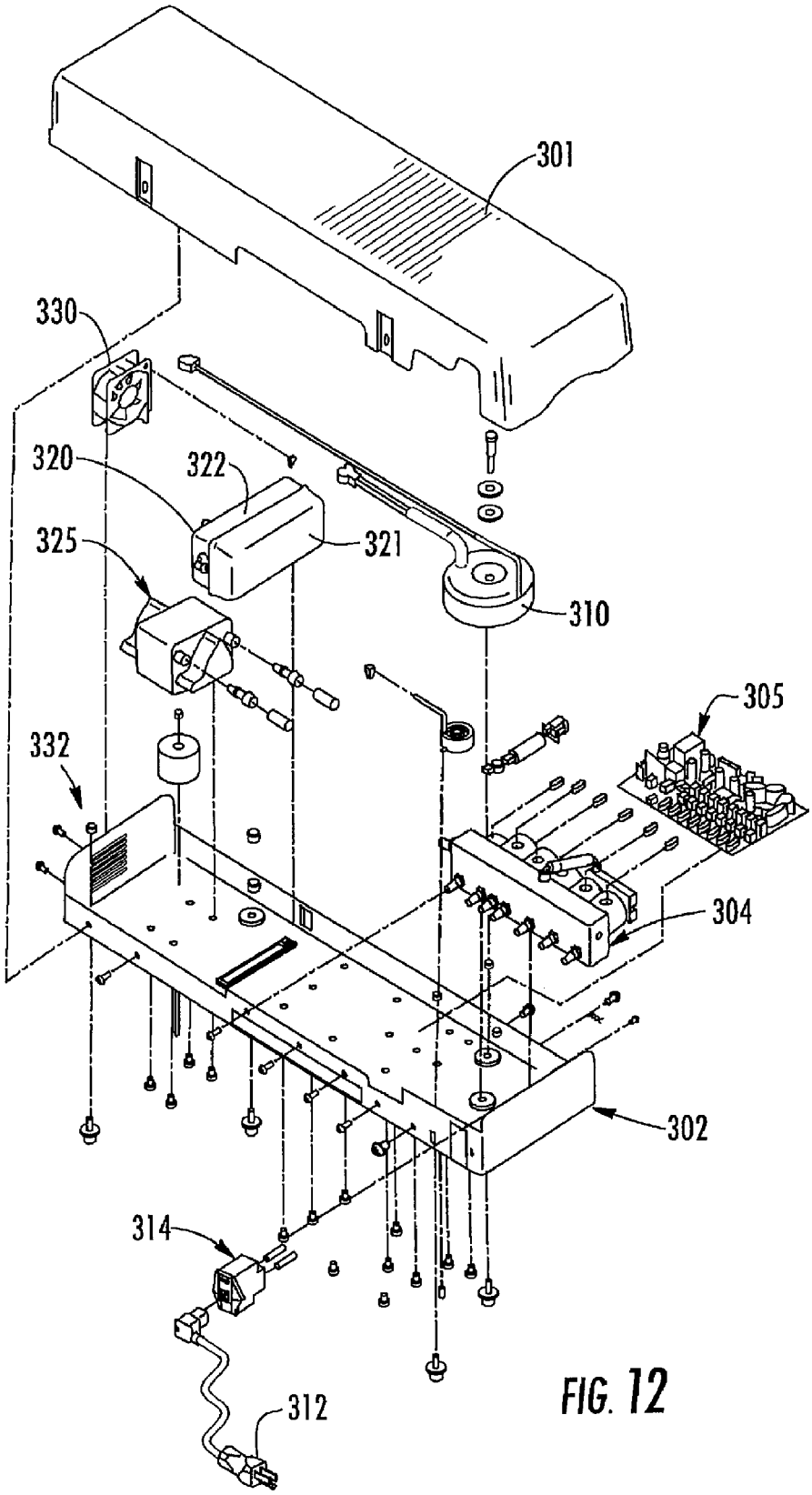
FIG. 12 illustrates an exploded view of an embodiment of the control box assembly according to the present invention.
Figure 14:
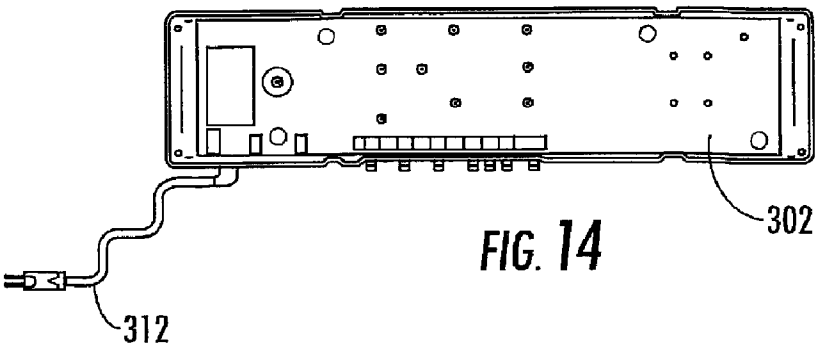
FIG. 14 is a top view of an embodiment of a control box bottom cover according to the present invention.
Figure 13:
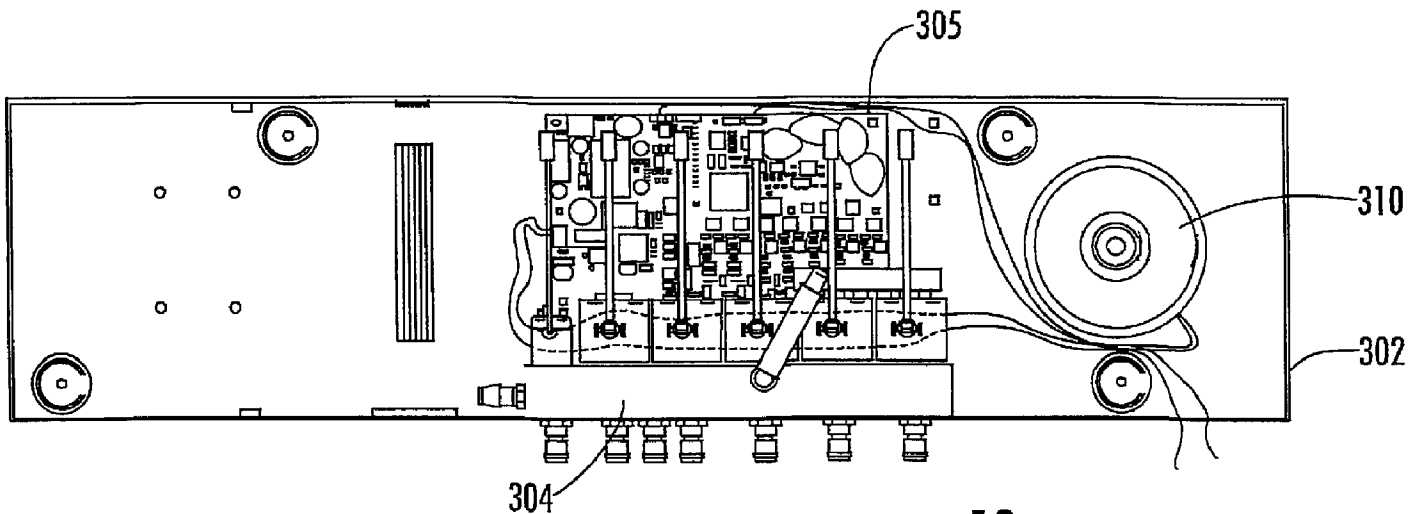
FIG. 13 illustrates a top view of an embodiment of the control box assembly according to the present invention without a control box top cover.
Figure 15A:
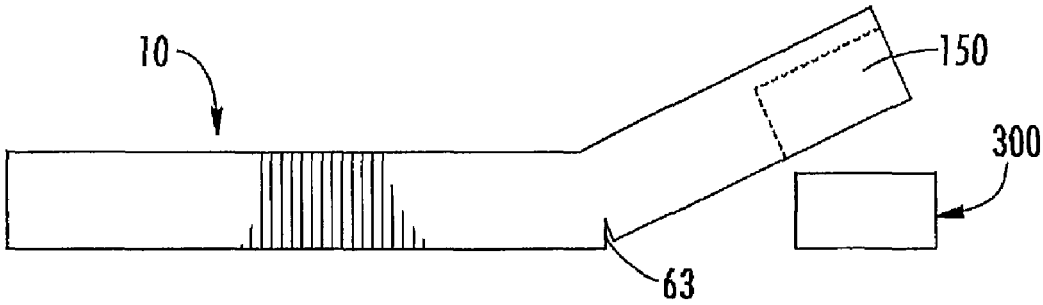
FIG. 15A is a side view of a control box and a patient lying surface according to one embodiment of the present invention.
Figure 15B:
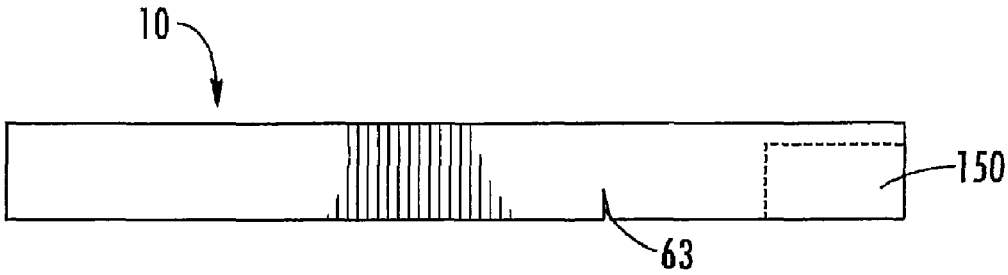
FIG. 15B is a side view of a patient lying surface and an embedded control box and according to another embodiment of the present invention.
Figure 16:
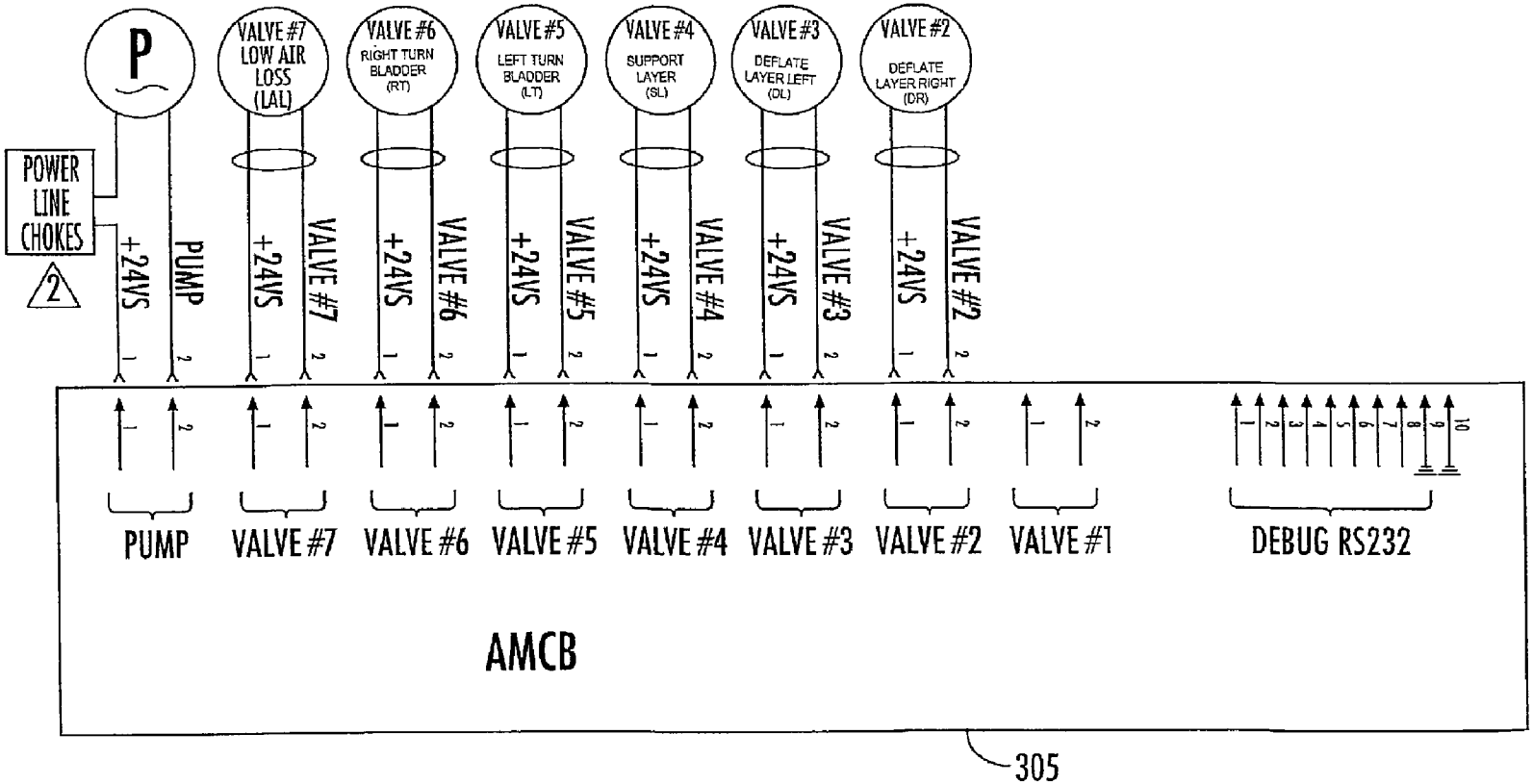
FIG. 16 illustrates a schematic representation of the electrical circuitry between the air main control board and various valves of a patient lying surface according to one embodiment of the present invention.

Referring to FIG. 5, a group of turning bladders 50 may be formed by two bladders 52, 54 that run longitudinally (elongated longitudinally). As depicted in FIG. 5, group of turning bladders 50, according to one embodiment of the present invention, is bottle-shaped with an enhanced width part 55 proximal to the head end 11 of the patient support surface 10 (corresponding to the head and upper torso of the patient) and a reduced width part 56 in proximity of the foot end 12 of the patient support surface 10. One function of the group of turning bladders 50 is to provide assistance in turning the patient in order to facilitate the administration of care or treatment to the patient. Each of the two sections 52, 54 that run longitudinally is independently and operatively connected to the inflating/deflating system 100 via the tubing system 102. Primary hoses 53 run from sections 52, 54 to valve manifold assembly 304 (FIGS. 12-14) of control box assembly 300 (FIGS. 8 and 12). Secondary hoses 51 (FIGS. 8-10) run from sections 52, 54 to CPR manifold 108 (FIGS. 1B and 8-10).

Alternately, the turning bladders 52, 54 may be in fluid communication with the opposite section of the lower cushion formed by lower group of cushion bladders 40. For example, bladder 52 may be in fluid communication with bladders 40*a*, while bladder 54 may be in fluid communication with bladders 40*b*. In this manner, air flow between the respective bladders will allow one set of bladders in the lower group of bladders to deflate while the opposite turning bladder is inflating. For example, if you want to turn a patient to the right, the left turning bladder will be inflated and the right section of the lower group of bladders will deflate. This will allow repositioning of the patient over a full range of motion while still retaining the patient on the foam crib. As would be understood, some level of air cushioned support may still be provided under the patient when in a turned position.

The above described shape of the group of turning bladders 50 may be designed to provide alignment of the back, hip and legs of the patient when operating the turn-assist function of the patient support surface 10. For proper care and treatment, it is usually important to be able to rotate the patient along the longitudinal axis of his body.

In one embodiment of the present invention, group of turning bladders 50 is affixed to top cover 15 (or a coverlet) and to bottom cover 80 through bladder anchoring system 130 (see below).

In another embodiment of the present invention, upper group of cushion bladders 30 is not affixed to top cover 15 (or to a coverlet where applicable).

A worker skilled in the art would readily understand that variations of the shape of the group of turning bladders 50 could be made without departing from the scope of the instant invention.

The Bladder Anchoring System

Figure 9:
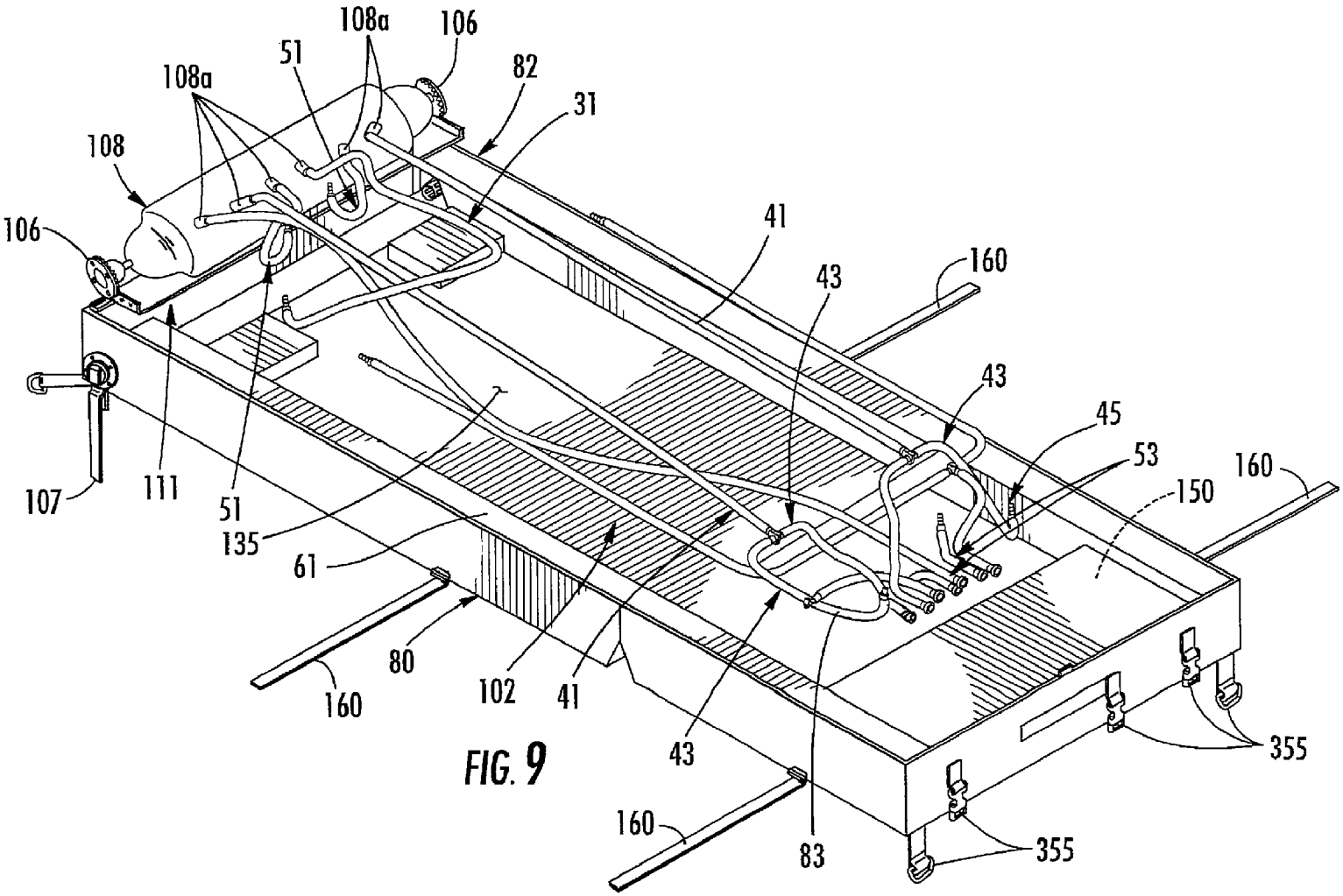
FIG. 9 is an isometric view of a tubing system, a foam crib and a bottom cover according to an embodiment of the present invention.

According to an embodiment of the present invention, a plurality of flexible bladder securing means 140 are provided that connect to the various bladders to hold them into place, thus forming a bladder anchoring system. In addition, bladder anchoring system 130 may include a plurality of tethers 132, such as flexible bands or straps, that run throughout the various bladders of the patient support surface 10 and through anchoring slits 134 found in upper group of cushion bladders 30, lower group of cushion bladders 40 and group of turning bladders 50 (see FIGS. 3C, 4B, and 5 respectively) and bottom foam piece 64 of foam crib 60. Tethers 132 extend through the various bladders and further through cradle 60 with their ends trapped between cradle 60 and bottom cover 80. In the illustrated embodiment, tethers 132 are coupled to anchors 135, which are trapped between cradle 60 and bottom cover 80. Further, in the illustrated embodiment, anchors 135 comprise flanges or plates that have a transverse dimension that is sufficient to prevent the anchors from passing through the openings formed in the cradle through which the tethers extend. By trapping the ends of the tethers 132 between the cradle and the bottom cover, the bladders are stabilized and tethered to the cradle. Anchors 135 may be positioned to correspond to the tethers 132 and anchoring slits 134, located on the bottom cover 80 (FIG. 9). Tethers 132 can, after running throughout the various bladders of the patient support surface 10 through anchoring slits 134 as described above, be firmly attached to the anchors at their distal ends. While illustrated as a separate component, the anchors may be formed by the ends of the tethers themselves, where the tethers have enlarged ends. Further, the proximal ends of vertical tethers 132 may be attached to top cover 15 or a coverlet where applicable. In an alternative embodiment, the proximal end of tethers 132 may be attached to the upper group of cushion bladders (see FIG. 3B).

A worker skilled in the art would appreciate that various means of anchoring the upper group of cushion bladders 30, lower group of cushion bladders 40, and group of turning bladders 50 to the patient support surface 10 could be used without departing from the scope of the present invention.

The Inflating/Deflating System

Referring to FIG. 8, inflating/deflating system 100 may comprise a tubing system 102, a CPR manifold 108, a CPR manual pull valve 106 and a control box assembly 300. The inflating/deflating system 100 may operate several features of the patient support surface 10, such as full body pressure redistribution, adjustable firmness, low air loss, maximum inflate, turn-assist and emergency deflation for CPR administration.

Pressurized air is provided to the various bladders by means of an air pump 325 located within control box assembly 300. Control box assembly 300 is embedded into the patient support surface 10, in proximity to the foot end 12.

Control Box Assembly

As best seen in FIG. 12, control box assembly 300 includes a control box top cover 301 and a control box bottom cover 302 (see also FIGS. 13 and 14), which form, when mated, a substantially rectangular control box assembly casing 303. As depicted in FIG. 12, several components of the control box assembly 300 are located within the control box assembly casing 303 or connected thereto. A power cord 312 may be connected to a side control box bottom cover 302, with an electrical circuit running from power cord 312 to an AC switch 314, to a toroid 310 for converting the voltage from an outlet voltage (e.g. 120V) to an appropriate lower voltage for the operation of the control box assembly 300, and to an air main control board (AMCB) 305. The air main control board (AMCB) 305 is electrically connected to air pump 325 and valve manifold assembly 304. The air intake and exit to and from the air pump 325 is through canister assembly 320. In the illustrated embodiment, canister assembly includes two chambers, namely an intake chamber 321 and an exit chamber 322. The air enters the canister assembly 320 by intake chamber 321, and then proceeds to the intake of the air pump 325 where it is compressed and pumped out of the air pump 325 through the exit chamber 322 of the canister assembly 320. The chambers of the canister assembly 320 absorb vibration and minimize noise generated by air pump 325. The air then goes through the valve manifold assembly 304 and proceeds to the tubing system 102. Alternately or in addition, manifold 304 may have enlarged chambers, which may provide vibration and noise reduction.

In one embodiment of the present invention, control box assembly 300 further comprises a fan 330 set in a fan enclosure 332 one of side foam pieces 61 and 62 of foam crib 60 to exit air out of the control box assembly 300. In one embodiment of the present invention, control box assembly 300 further comprises various sensors or sensor reading electronics.

In another embodiment of the present invention (not shown), the control box assembly 300 is powered by means of a battery pack. In a further embodiment (not shown), control box assembly 300 is powered through the power source of the patient support apparatus or bed.

To inflate and maintain pressure in the patient support surface 10, electrically powered air pump 325 supplies air under pressure through tubing system 102, with upper group of cushion bladders 30 connected to the inflating/deflating system 100 via the tubing system 102 through connectors 35 (FIGS. 3A-3C), lower group of cushion bladders 40 operatively connected to the inflating/deflating system 100 via the tubing system 102 through connectors 45, and group of turning bladders 50 operatively connected to the inflating/deflating system 100 via the tubing system 102 through connectors 155.

Primary hoses 103 run from air pump 325 (within the control box assembly 300) to each of upper group of cushion bladders 30, lower group of cushion bladders 40 and turning bladder 50 (or respective bladders of upper group of cushion bladders 30, lower group of cushion bladders 40 and turning bladder 50) via valve manifold assembly 304. Valve manifold assembly 304 distributes the airflow from air pump 325 to the various bladders of the patient support surface 10 according to the required need. Secondary hoses 31, 41 and 51 run from CPR manifold 108 to primary hoses 103 connected to upper group of cushion bladders 30, lower group of cushion bladders 40 and turning bladder 50 respectively, or respective bladders of upper group of cushion bladders 30, lower group of cushion bladders 40 and turning bladder 50.

Figure 17:
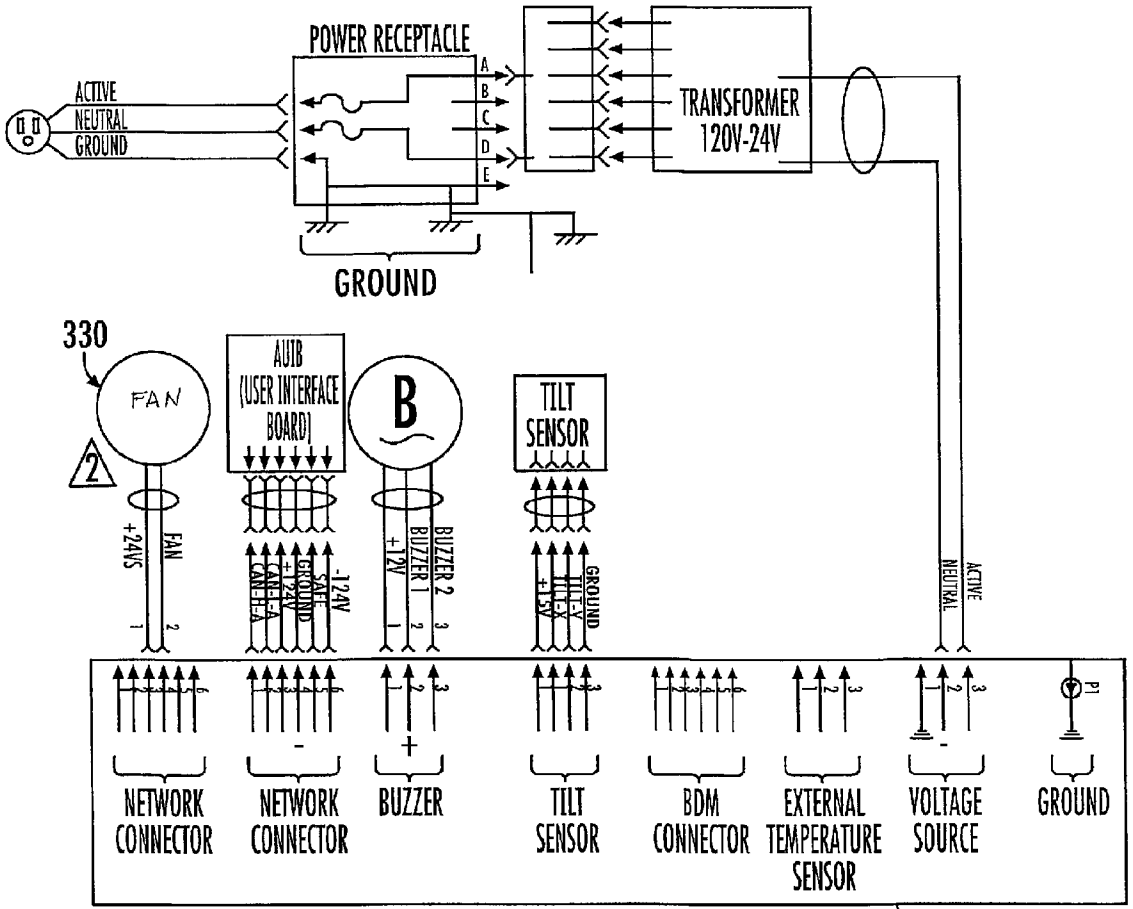
FIG. 17 illustrates a schematic representation of the electrical circuitry between the air main control board and other components of a patient lying surface according to one embodiment of the present invention.

FIGS. 17A and 17B diagrammatically shows a configuration of the integration of the control box assembly 300 in the patient support surface 10 according to one embodiment of the present invention. At the foot section of the patient support surface 10 there is a control box assembly enclosure 150 in the bottom of bottom cover 80 facing downward from patient support surface 10. The control box assembly 300 (comprising air pump 325) fits into control box assembly enclosure 150 and is secured in place by two or more control box assembly securing straps 355. The control box assembly securing straps 355 are affixed, optionally permanently affixed, along both sides (running transverse across the patient support surface 10) of the control box assembly enclosure 150. Each control box assembly securing strap 355 can be coupled to a complementary control box assembly securing strap 355 on opposite side of the control box assembly enclosure 150 via a strap coupling means (See FIG. 7C). When the two or more control box assembly securing straps 355 are coupled to their respective complementary control box assembly securing straps 355, the control box assembly 300 is secured to the patient support surface 10 and embedded therein. As such, the patient support surface 10 is easily adaptable to a variety of patient support apparatuses or beds.

The patient support surface 10 according to an embodiment of the present invention comprises a feature which assists the care provider in efficiently providing cardiopulmonary resuscitation (CPR) to a patient lying thereon. The CPR manifold 108 is embedded within the patient support surface 10 proximal to the head end 11 thereof. The relative positioning of the CPR manifold 108 is above the foam crib 60 and bottom cover 80 (see FIGS. 1 and 9) and underneath the top cover 15 (or a coverlet where applicable), the upper group of cushion bladders 30, the lower group of cushion bladders 40 and the group of turning bladders 50 (see FIG. 1 for example).

Figure 18:
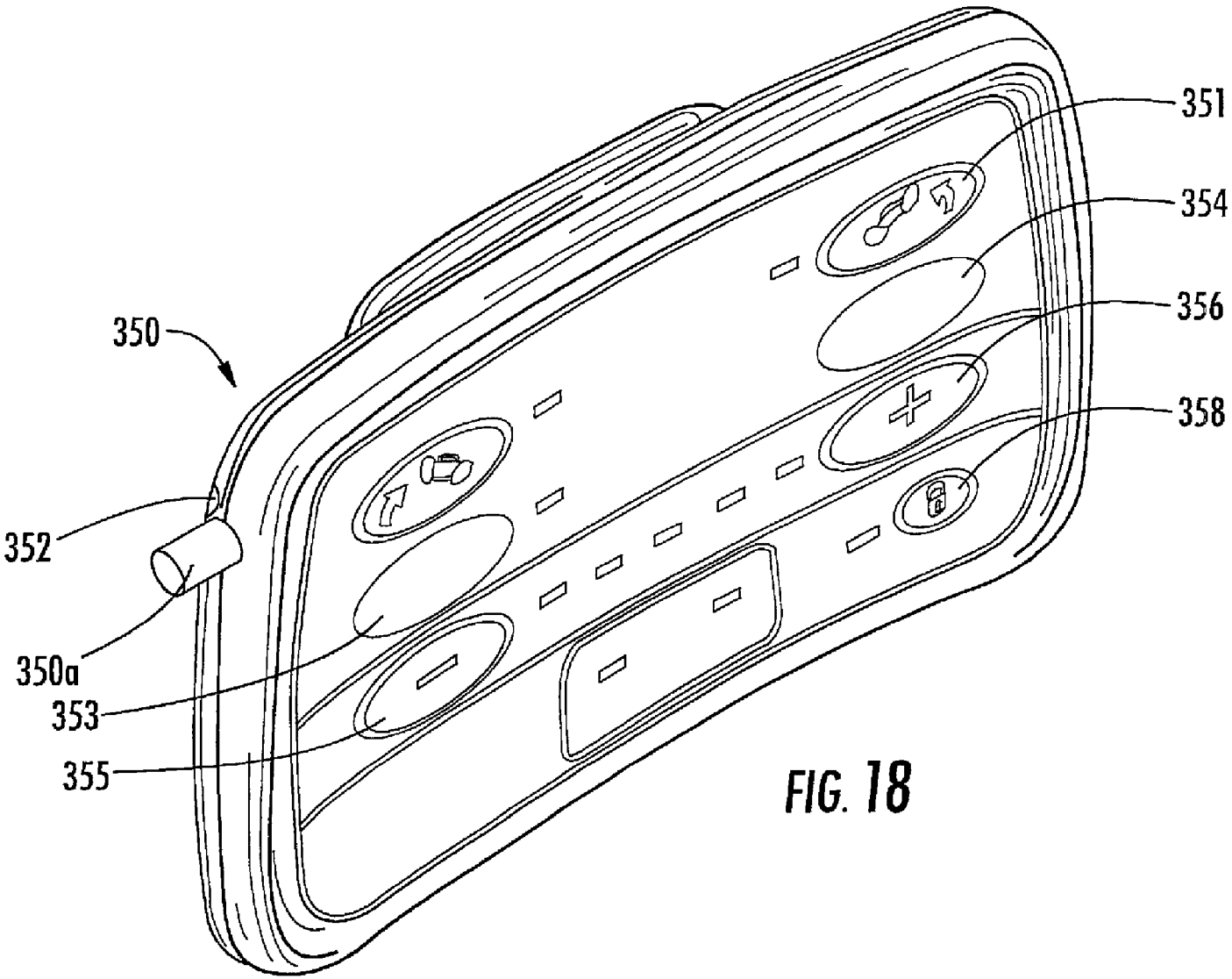
FIG. 18 is an isometric view of a control pendent that may be used to control the inflation/deflation system of the present invention.

FIG. 18 illustrates a schematic representation of the electrical circuitry between the air main control board (AMCB) 305 and various valves of a patient support surface 10 according to one embodiment of the present invention.

Figure 19:
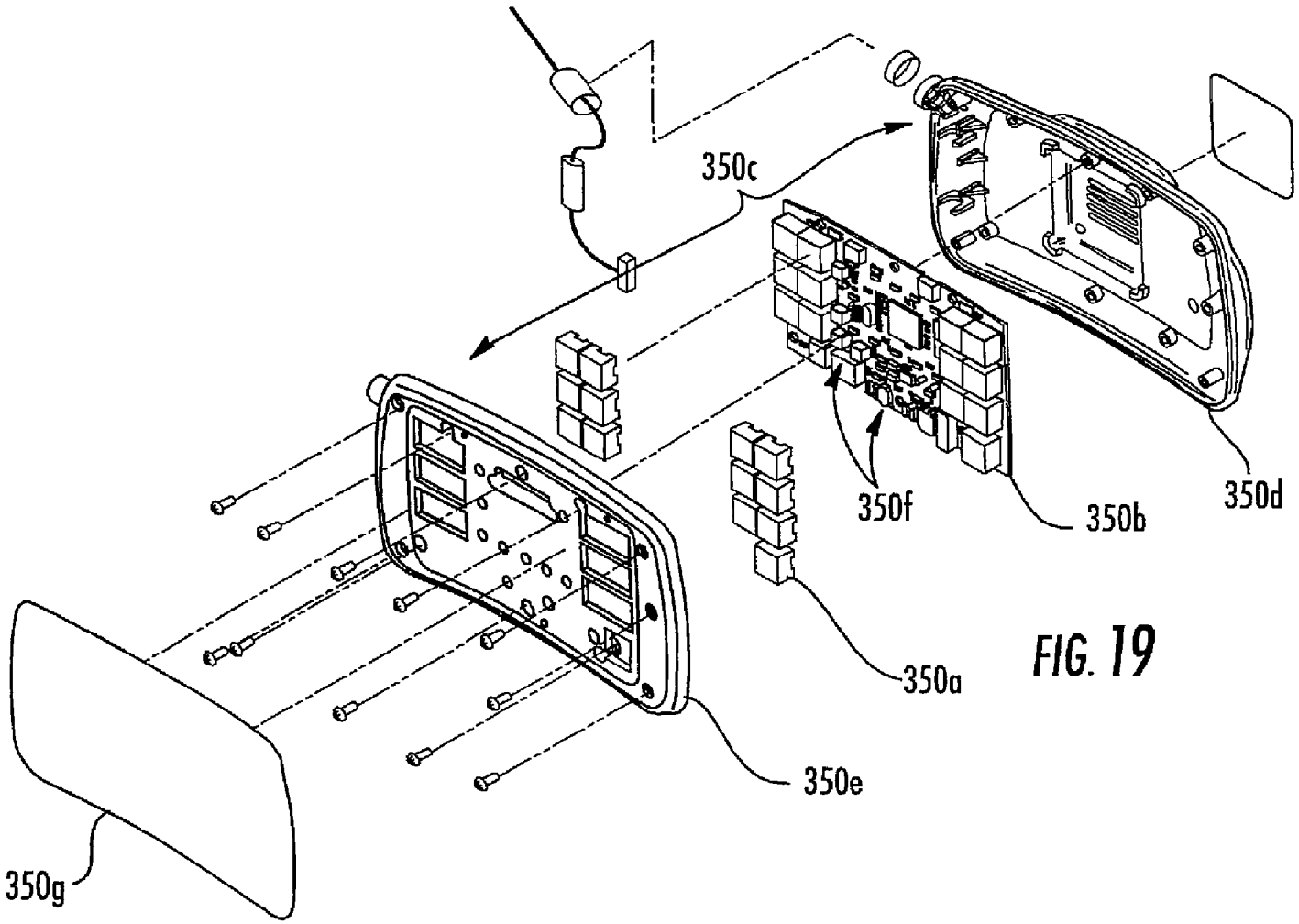
FIG. 19 is an exploded perspective view of the control pendent of FIG. 18.

FIG. 19 illustrates a schematic representation of the electrical circuitry between the air main control board (AMCB) 305 and other components of a patient support surface 10 according to one embodiment of the present invention.

The Tubing System

Figure 10:
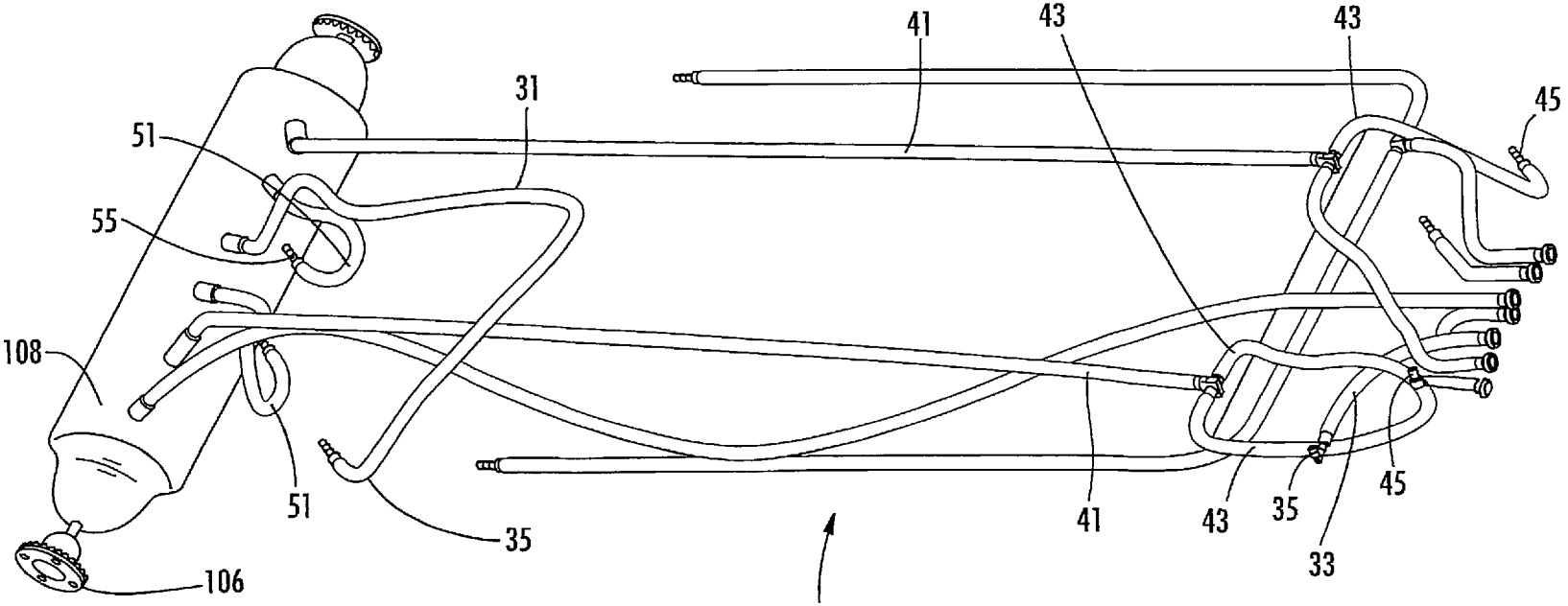
FIG. 10 is an isometric view of a tubing system and CPR manifold according to an embodiment of the present invention.

FIG. 10 depicts a tubing system 102 according to an embodiment of the present invention. Tubing system 102 comprises primary hoses 103 running from valve manifold assembly 304 (not shown) to each bladder of the upper group of cushion bladders 30, lower group of cushion bladders 40 and group of turning bladders 50 (see FIG. 12), and secondary hoses 31, 41 and 51 run from CPR manifold 108 to primary hoses 103 connected to upper group of cushion bladders 30, lower group of cushion bladders 40 and group of turning bladders 50 (not shown) respectively, or respective bladders of upper group of cushion bladders 30, lower group of cushion bladders 40 and group of turning bladders 50.

In one embodiment of the present invention, the tubing of the tubing system 102 which runs longitudinally are positioned in proximity of side foam pieces 61 and 62. This configuration helps avoiding the tubing from interfering with other components of the patient support surface and from inadvertently being disconnected from their respective bladder.

CPR Manifold Assembly

At the head section 11 of patient support surface 10, there is a CPR manifold assembly, which allows the bladders to be quickly deflated so that the patient is supported by the relatively rigid support surface under the inflatable bladders. In this manner, CPR can be administered quickly to the patient. In the illustrated embodiment, CPR manifold assembly includes a CPR manifold 108 and a CPR manifold pull valve 106, which when pulled releases air from the manifold. Manifold 108 is coupled to every bladder of the patient support surface 10 through secondary hoses 31, 41, and 51, which are connected to manifold 108 through check valves 108*a*. Secondary hoses 41 run from CPR manifold 108 to primary hoses 103 connected to upper group of cushion bladders 30, lower group of cushion bladders 40 and group of turning bladders 50 respectively, or respective bladders of upper group of cushion bladders 30, lower group of cushion bladders 40 and group of turning bladders 50, where applicable. Check valves 108*a* prevent air from flowing into the manifold when the pressure in the manifold exceeds the pressure in the support surface but open to allow air to flow into the manifold when the pressure in the manifold drops, for example, when the manifold pull valve is opened.

Figure 7B:
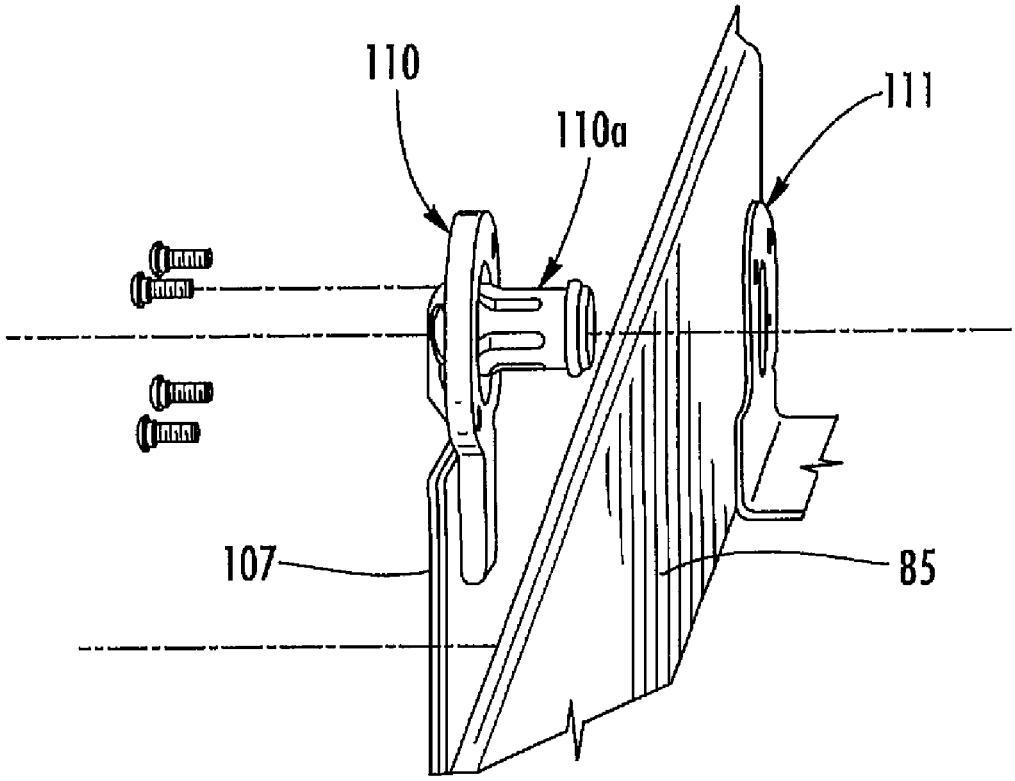
FIG. 7B is an enlarged view of the CPR manifold pull valve handle.
Figure 7C:
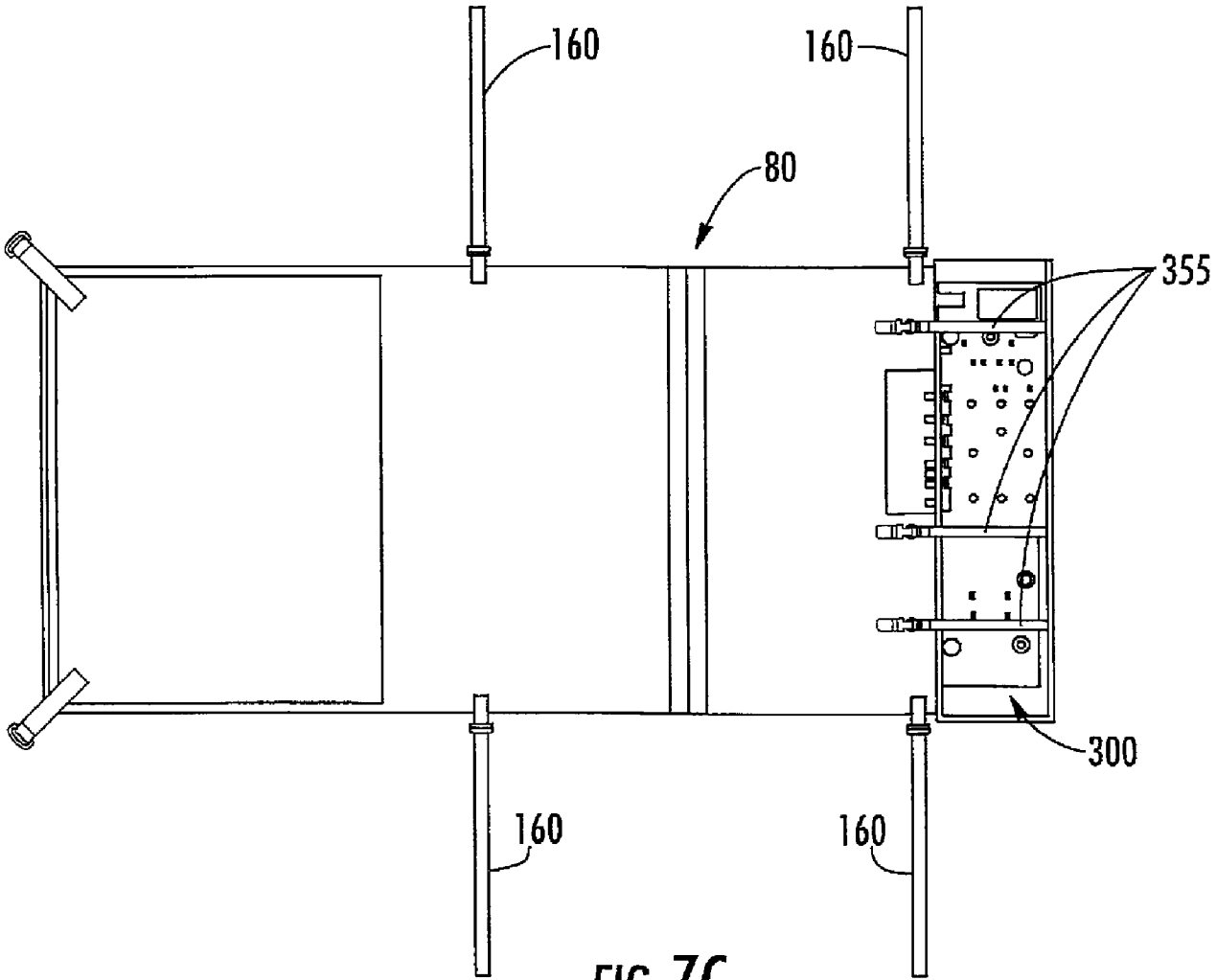
FIG. 7C is a bottom plan view of the bottom cover.

In the illustrated embodiment, manifold 108 is supported in base 80 by a CPR support 111, which is mounted to side walls 84 and 85 by fasteners (e.g. see FIG. 7B). CPR manifold 108 may be located within a CPR manifold enclosure 109 (FIG. 11) formed between the end of cradle 60 and base 80. As best understood from FIG. 7A, CPR manual pull valve 106 is operatively connected to a CPR plate 110 with a plug 110*a* and manual pull valve handle 107. Plate 110 is mounted to the exterior side of base 80, with plug 110*a* of CPR plate 110 extending through an opening 84*a* of sidewall 84 of bottom cover 80 and further into valve 106. As noted above, plate 110 includes a manual pull handle 107, which when pulled dislodges plug 110*a* from valve 106 to thereby open the valve and hence empty manifold 108. For further details of CPR manifold 108, reference is made to copending application entitled, filed Dec. 13, 2006, APPARATUS AND METHOD FOR RAPIDLY DEFLATING AIR CELLS WITH CHECK VALVES FOR CARDIO PULMONARY RESUSCITATION, owned by Sentech Medical Systems, Inc., which is herein incorporated by reference in its entirety.

In one embodiment of the present invention, the patient support surface 10 has two CPR manual pull valves 106, positioned on each side of the patient support surface 10 and operatively connected to the CPR manifold 108. As best understood from FIGS. 7A and 11, bottom cover 80, manifold 108 is supported between the side walls of bottom cover 80 and adjacent the end of crib 60. Further, each side wall of bottom cover 80 includes an opening, which allows the pull valve tab or handle 107 to couple to the respective pull valve 106 through the wall of the bottom cover 80.

As noted, the primary function of the CPR manifold assembly is to rapidly deflate and level the upper group of cushion bladders 30, lower group of cushion bladders 40 and group of turning bladders 50 of patient support surface 10 for enabling the administration of CPR procedures. As such procedures are often life preserving in nature, the time in which they can be administered to a patient is crucially important. To the CPR manifold assembly, the health care provider simply has to pull the CPR manual pull valve handle 107, which then disconnects from and unplugs CPR manual pull valve 106, causing all running functions of the patient support surface 10 to stop and all bladders thereof to instantly deflate.

The Foam Crib

Figure 6A:
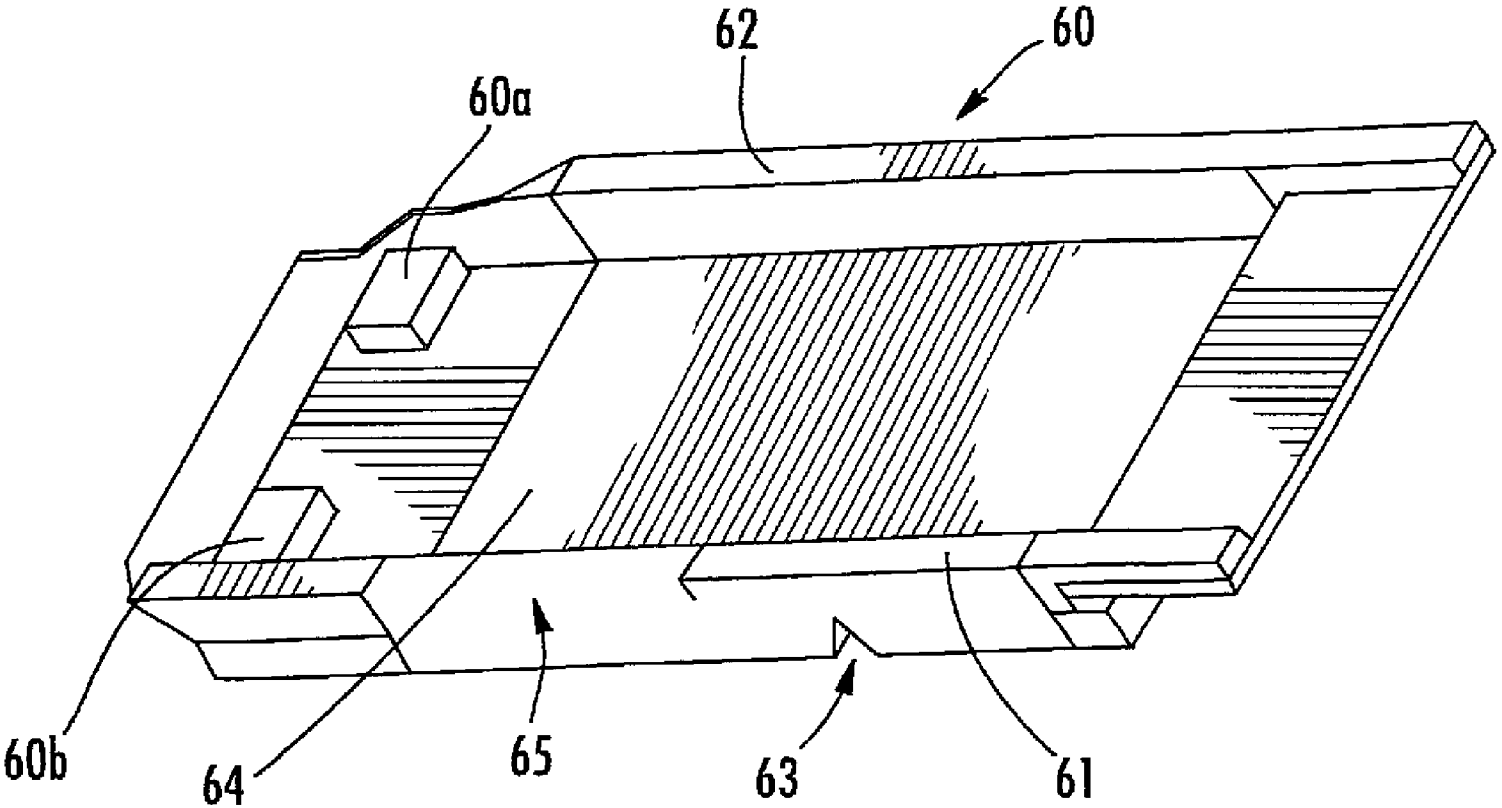
FIG. 6A is a partial isometric view of a foam crib according to an embodiment of the present invention.
Figure 11:
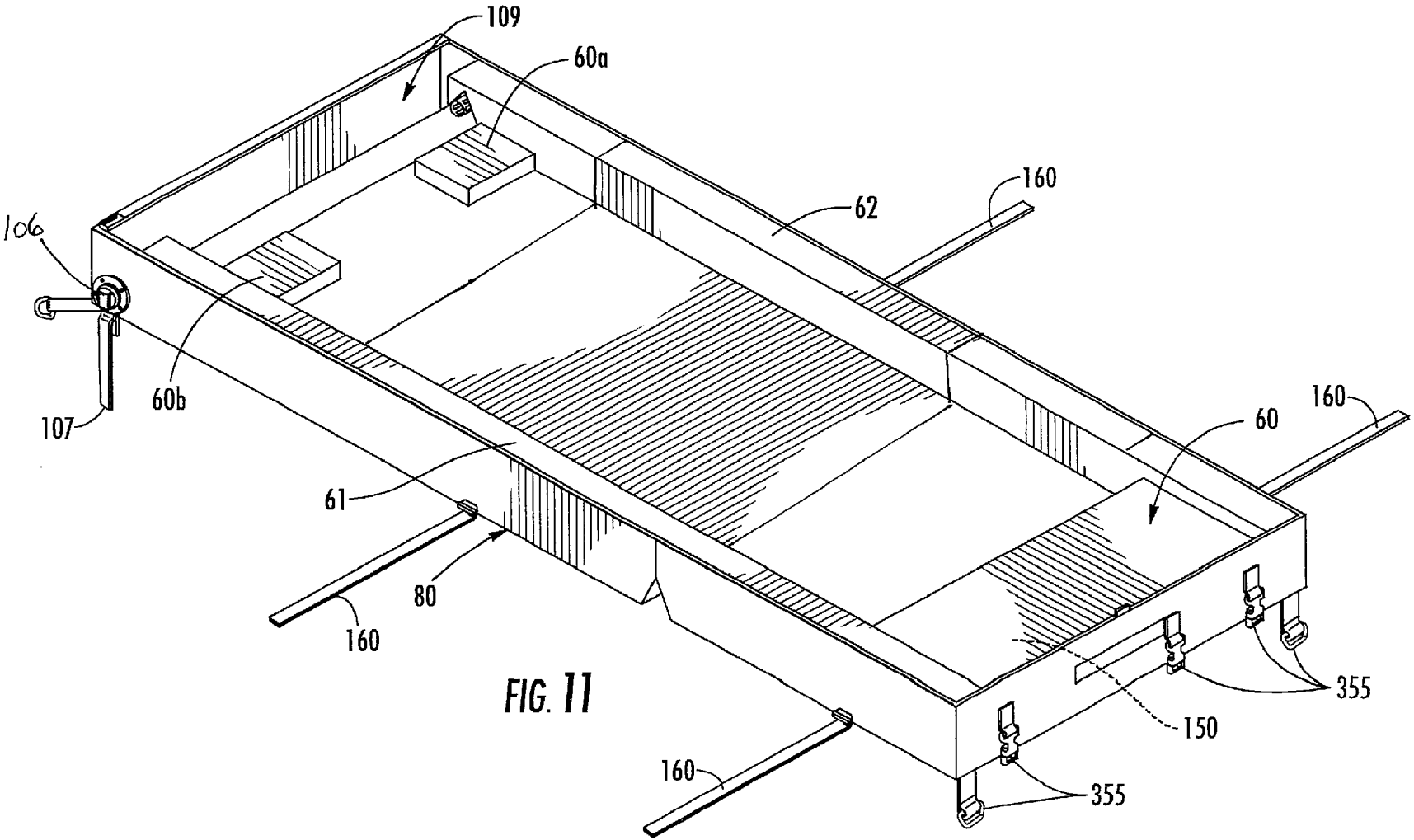
FIG. 11 is an isometric view of a foam crib and a bottom cover according to an embodiment of the present invention.

As depicted in FIGS. 6A and 11, the patient support surface 10 comprises a foam crib 60, which lies against the periphery of the inside of the bottom cover 80 to contain the patient substantially in the center of the bed or patient support apparatus. There are two side foam pieces 61, 62 that run longitudinal along the sides of the patient support surface 10. Side foam pieces 61, 62 are joined to a bottom foam piece 64, described below. The side foam pieces 61, 62 are glued to the bottom foam piece 64 and sealed with a thin cloth 65 to form an integral component. Further, foam crib 60 may incorporate areas 60*a* and 60*b* of increased thickness in bottom foam piece 64 at the head end of the crib to facilitate head positioning. For example, the increased thickness may be formed by the bottom foam piece 64 or by separate foam pads or pieces secured to the bottom foam piece, for example by glue.

Figure 6B:
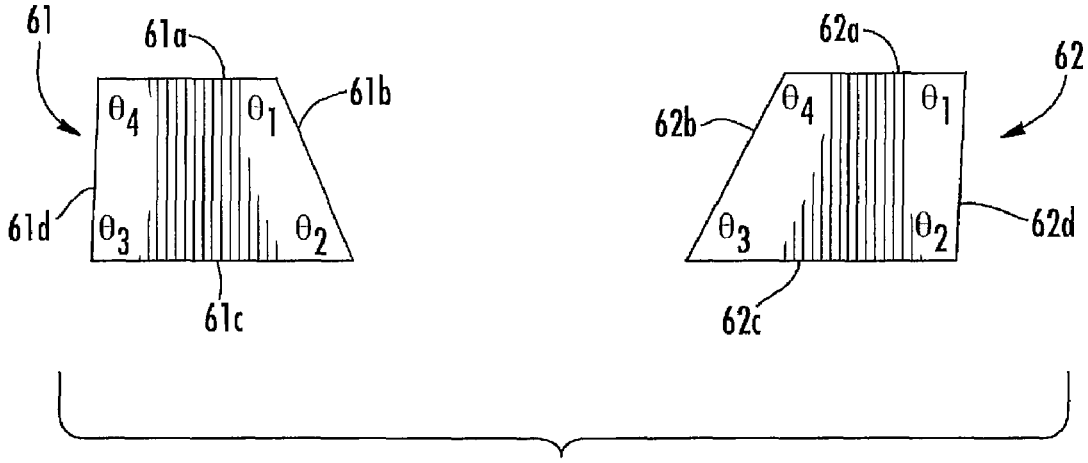
FIG. 6B is a transverse view of side foam pieces of a foam crib according to an embodiment of the present invention.

A transverse section view of side foam pieces 61, 62 according to one embodiment of the present invention is depicted in FIG. 6B. In this embodiment, side foam pieces 61, 62 each have a substantially trapezoidal shape with two angles $\theta_1$ and $\theta_2$ being substantially right angles while angle $\theta$3 is acute and angle $\theta$4 is obtuse. The respective top surfaces 61*a* and 62*a* are narrower than the respective bottom surfaces 61*c* and 62*c*. Respective inside lateral surface 61*b* and 62*b* of side foam pieces 61, 62 are oriented towards the center of the patient support surface 10. Respective outside lateral surfaces 61*d* and 62*d* are facing the outside of the patient support surface 10 and are substantially vertical. The shape of side foam pieces 61, 62 according to this embodiment of the present invention assist in maintaining the bladders (30, 40 and 50) and the patient in a proper position, in the center of the patient support surface 10.

The bottom foam piece 64 is made from a material that is strong, but of lower Indentation Load Deflection (ILD) than side foam pieces 61, 62. For example, side foam pieces 61, 62 may have an ILD in a range of 60 to 85, or in a range of 41-60, or in a range of 33 to 40. Suitable ILD's for side foam pieces include an ILD of 85, an ILD of 80, an ILD of 75, or an ILD of 70. Bottom foam piece 64 is cushy and comfortable and of minimal height. According to an embodiment of the present invention (see for example FIG. 11), bottom foam piece 64 is substantially rectangular in shape, extending laterally to the inner sides of bottom cover 80 under the side foam pieces 61, 62 and extending longitudinally to the respective enclosures 109 (FIG. 11), 150 for the CPR manifold 108 and control box assembly 300.

In one embodiment of the present invention, side foam pieces 61, 62 have an Indentation Load Deflection (ILD) of 85.

According to an embodiment of the present invention, there are compression gashes 63 may be provided in side foam piece 61, 62 in areas that are tailored to allow the patient support surface 10 to bend easily with the patient support apparatus or bed as various sections thereof are articulated. For example, in the embodiment depicted at FIG. 11, compression gashes 63 in side foam pieces 61, 62 are positioned for the patient support surface 10 to accommodate a patient support apparatus or a bed which has a movable foot section. Compression gashes 63 are always in corresponding positions on both side foam pieces 61 and 62. Bottom cover 80 is designed so that the base portion 88 thereof contours the compression gashes 63 and thereby avoids hindering the bending of the patient support surface 10. The number of compression gashes in side foam pieces 61 and 62 may vary and may include, for example, two compression gashes 63, four compression gashes 63, six compression gashes 63, eight compression gashes, or ten compression gashes.

A worker skilled in the art would understand that the foam crib 60 according to embodiments of the present invention does not necessarily need to be made of foam and that any relatively soft material with an appropriate Indentation Load Deflection, as described above.

The Bottom Cover

In reference to FIG. 7, the bottom cover 80 of the patient support surface according to an embodiment of the present invention comprises side walls or portions 85, a head wall or portion 86, a foot wall or portion 87 and a base wall or portion 88.

The bottom cover 80 is designed to cover the bottom but also covers the outside walls of the patient support surface 10. In one embodiment of the present invention, the underside surface of base portion 88 of bottom cover 80 is made of or has a layer of non-skid material on the section proximal to the foot portion 87. The underside surface section of base portion 88 of bottom cover 80 proximal to the head portion 86 is made of or has a layer of a slippery material such as, without limitations, nylon. The side portions 85 of bottom cover 80 are fabricated from (or covered with) a thick non-skid material, which is of high-resistance. In this manner, when surface 10 is resting on a frame, such as a deck assembly of a bed, the head end of surface 10 can slide relative to the frame, for example, when surface 10 is being lifted or folded.

Bottom cover 80 also comprises anchoring points 135 of the bladder anchoring system 130.

The Patient Support Surface Attachment Means

Referring now to FIGS. 1A, 1B, 7A, 9 and 11, attachment straps 160 are provided on the surface 10 according to one embodiment of the present invention. There is a plurality of attachment straps 160 affixed to the bottom cover 80 at many locations of the sides thereof. Attachment straps 160 allow the patient support surface 10 to be adapted and secured to many types of patient support apparatuses or beds in different ways. For example, without limitations, attachment straps 160 can be attached to a deck support or an intermediate frame of a patient support apparatus or bed.

According to an embodiment of the present invention, attachment straps 160 are also provided on the head end 11 and foot end 12 of patient support surface 10.

Control Pendant

Referring to FIG. 18, inflation/deflation system 100 may be controlled by a control pendant 350. Control pendent 350 is operatively connected to the control box assembly 300 to communicate therewith. In these embodiments, the connection is through a communication wire. Control pendant 350 provides an interface for a health care provider to control the operation of several features of the patient support surface 10 such as full body pressure redistribution, adjustable firmness, low air loss, maximum inflate, turn-assist and emergency deflation for CPR administration.

Alternately, control pendant 350 may communicates with the control box assembly 300 via wireless communication means.

In one embodiment of the present invention, the control box assembly 300 is operatively connected to the patient support apparatus' or bed's communication network, such as a CAN network, which is coupled to one or more bed control panels, including a touch screen, to allow a user to control various functions on the bed or review the status of various functions on the bed. In this manner, the control of the control box assembly 300 and the functions of the patient support surface may therefore be effected through the support apparatus' or bed's control panel.

Control pendant 350, as depicted in the exemplarily embodiment of FIGS. 18 and 19, includes a plurality of control buttons 350*a* and an interface control board 350*b*, which is in communication with buttons 350*a* and control board 305 of control box 300. Buttons 350*a* and board 350*b* are housed on a housing 350*c*, which includes a back housing member 350*d* and a cover plate 350*e*, which covers board 350*b*, but provides openings through which buttons 350*a* and the indicator lights 350*f*, such as LEDs, (all of which are mounted to board 350*b*) extend for viewing and access by a user. Further, buttons 350*a* and indicators 350*f* are sealed in housing 350*c* by a flexible cover 350*g*, such as a membrane, which allow a user to activate the buttons through the flexible cover.

Control buttons 350*a* may include, for example, Turn-Assist Right 351, Turn-Assist Left 352, Max Inflate 353, Stop 354, Firmness Decrease 355, Firmness Increase 356, Default Firmness 357 (not shown), Lock 358, Maintenance Call 359 (not shown), etc. As would be understood, when any one of these control buttons is actuated, typically by pressure, the control board will actuate the pump or deactivate the pump as appropriate for the selected function or generate the appropriate signal for the alarm or lock functions.

Sensors

The patient support surface 10 according to one embodiment of the present invention comprises various sensors to perform specific functions. These sensors can be of all or some of the following categories: pressure sensor(s), angle or tilt sensor(s), temperature sensor(s) and humidity sensor(s).

The pressure sensor(s) are used to measure the pressure on a patient's body lying on the patient support surface 10 by measuring the applied pressure in various points of the patient support surface 10. The pressure sensor(s) can be placed in several locations, for example, without limitations, on either face of the top cover 15, on the coverlet, on upper group of cushion bladders 30, on lower group of cushion bladders 40, on group of turning bladders 50, etc.

The angle or tilt sensor(s) may be used to measure the inclination angle(s) of various sections of a patient support surface 10 used with a patient support apparatus or bed which has moveable sections. The angle or tilt sensor(s) can be located in several locations, for example, without limitations, on either face of the top cover 15, on the coverlet, on upper group of cushion bladders 30, on lower group of cushion bladders 40, on group of turning bladders 50, on either face of the bottom cover, etc.

The temperature sensor(s) are used to measure the temperature of a patient's body lying on the patient support surface 10, and are situated, without limitations, on either face of the top cover 15, on the coverlet, etc.

The humidity sensor(s) are used to measure the relative humidity of a patient's body lying on the patient support surface 10, and are situated, without limitations, on the top surface of top cover 15 or a coverlet, etc. The humidity sensor(s) may be useful to monitor or detect possible medical conditions, such as bed ulcers, which are affected by the humidity.

It should be understood that other possible types of sensors could be used within the present invention such as, without limitations, integrated circuit sensors, Piezo sensitive devices, angular sensors, potentiometers, contact switches, capacitors, Temposonic™ (linear position sensors and transducers . . . ), magneto resistive elements, optical sensors, camera sensors, radar sensors, ultrasonic sensors, magnetic sensors, or any combination thereof.

As noted, the various functions of the patient support surface 10 may be controlled via the control pendant 350, and examples thereof are described below.

Turn-Assist Operation

The turn-assist function of the patient support surface 10 assists a health care provider in turning bed-ridden patients. The patient should be positioned along the longitudinal centerline of the patient support surface 10 to facilitate turning. Failure to position the patient along the patient support surface centerline before starting the turn-assist function could result in patient injury. In an embodiment of the present invention, it is preferable to raise the patient support apparatus siderails. Then, the health care provider can initiate the turn-assist by selecting the corresponding function (turning the patient on the left or on the right) on the control pendant 350 (or on the patient support apparatus' or bed's communication network control panel).

A function selection signal is then transmitted from the control pendant 350 to the air main control board 305 of control box assembly 300. Air main control board 305 then operatively coordinates the for the air pump 325, valve manifold assembly 304 to inflate one of the two bladders 52, 54 that run longitudinally in group of turning bladders 50 (as depicted in FIG. 5). If the patient needs to be turned to the right, the left bladder 52 will be inflated and conversely, if the patient needs to be turned to the left, the right bladder 54 will be inflated.

Patient Support Surface Firmness Adjustment

Patient support surface firmness settings may be adjusted for patient comfort requirements. In one embodiment of the present invention, default firmness is pre-determined and pre-programmed. For example, the default firmness may be pre-programmed to be in a range of 20 to 25 mmHg, 25 to 30 mmHg, or 15 to 20 mmHg and may, for example, be pre-programmed to be about 22 mmHg.

The determination of the default firmness value will depend on the weight of the patients, with higher settings being typically preferable for heavier patients.

Using the control pendant 350 (or on the patient support apparatus' or bed's communication network control panel), the "Max inflate" function of the patient support surface may be selected, which allows nurses to inflate the patient support surface 10 to a maximum predetermined pressure to facilitate patient manipulation and transfer to or from patient support surface 10. For example, a maximum predetermined pressure may be in a range from 70 to 80 mmHg, in a range from 60 to 70 mmHg, or in the range from 50 to 60 mmHg. In various embodiments, maximum predetermined pressure may be 80 mmHg, 70 mmHg, 60 mmHg, or 50 mmHg.

CPR State

Another feature of the patient support surface 10 according to an embodiment of the present invention is the CPR state of the patient support surface 10 via the CPR manifold assembly. As described previously, a function of the CPR manifold assembly is to rapidly deflate and level the upper group of cushion bladders 30, lower group of cushion bladders 40 and group of turning bladders 50 of patient support surface 10 for enabling the administration of CPR procedures and to stop every running features of the patient support surface 10. Since CPR procedures can often be life preserving in nature, the time in which they can be administered to a patient is sensitive.

In one embodiment of the present invention, the CPR state feature of the patient support surface 10 is not controlled from the control pendant 350 but rather from the CPR manifold assembly. To initiate the CPR state feature, the health care provider simply has to pull on CPR manual pull valve handle 107 of a CPR manual pull valve 106, which will cause all other running functions or features of the patient support surface 10 to stop and all inflated bladders thereof to rapidly deflate. The patient is then in a proper position for receiving CPR procedures, lying flatly on a firm surface.

In another embodiment of the present invention, the CPR manual pull valve 106 is replaced by a CPR electrically powered valve 106*a* (not shown) operatively connected to and controlled via the control pendant 350. In such an embodiment, control pendant 350 comprises a CPR valve activation button to initiate the CPR state feature.

In one embodiment of the present invention, an indicator or alarm signal is activated on the control pendant 350 whenever the CPR positioning feature is initiated.

While several embodiments have been shown and described, modifications and variations may be made without departing from the scope of the invention. For example, the present invention has been described in reference to a pneumatic bladder system; however, while air may be preferable, any suitable fluid, such as other gases or liquids may be pumped into the various bladders without exceeding the scope of the invention. Thus, while the term "air: has been used throughout the specification, the term "air" should be understood to mean any suitable fluid, gaseous or liquid.

Further, the present invention has been described for use in association with a patient bed, which typically include a frame system comprising a base frame supported on the floor, for example by a plurality of caster wheels, an intermediate frame supported by an elevation system, a deck support connected to the intermediate frame and one or more side rails. A worker skilled in the art would readily understand that a bed can be configured in other ways. The patient support surface according to the present invention would be readily usable with alternate patient support apparatus, including for example, a stretcher, a cot, or the like.

In addition, the present invention makes reference to various components as being made of foam (for example foam crib and components thereof, IV tube management fastener and components thereof, etc.). It should be understood that the term "foam" is intended to mean any relatively soft material with an appropriate Indentation Load Deflection.

Unless defined otherwise, all technical and scientific terms used herein have the same meaning as commonly understood by one of ordinary skill in the art to which this invention belongs.

We claim:

1. A patient support apparatus comprising:

a support surface, said support surface including at least two longitudinal fluid bladders forming a bladder layer, at least one turning bladder beneath said fluid bladders, a base wall, and a cradle, said cradle formed from a compressible material and having a compressible lower wall supported by said base wall, and said bladder layer being supported by said cradle and having a tether attached on one end to the bladder layer intermediate said fluid bladders and trapped at another end between the compressible lower wall of said cradle and said base wall; and a fluid delivery system configured to deliver fluid to said bladder.

2. The patient support apparatus according to claim 1, wherein said tether comprises at least one strap.

3. The patient support apparatus according to claim 2, wherein said strap extends through said compressible lower wall.

4. The patient support apparatus according to claim 2, wherein said support surface includes a plurality of said bladder, a first group of said bladders arranged longitudinally along said cradle, a second group of said bladders arranged transversely along said cradle.

5. The patient support apparatus according to claim 4, wherein each of said groups of bladders is tethered by said strap or another tether.

6. The patient support apparatus according to claim 4, wherein said first group of bladders and said second group of bladders are tethered by said at least one strap, said strap extending through said compressible lower wall.

7. The patient support apparatus according to claim 4, wherein a third group of said bladders is arranged longitudinally along said cradle beneath said second group of bladders.

8. The patient support apparatus according to claim 7, wherein said third group of said bladders comprises turning bladders.

9. The patient support apparatus according to claim 8, wherein said third group of bladders is tethered by said at least one strap.

10. The patient support apparatus according to claim 9, wherein said groups of bladders are tethered by a plurality of straps, each of said straps being trapped between said compressible lower wall and said base wall.

11. The patient support apparatus according to claim 10, wherein each of said straps has an anchor, said anchors being trapped between said compressible lower wall and said base wall.

12. A patient support apparatus comprising:

a support surface, said support surface including a plurality of fluid bladders, a base wall, and a cradle, said cradle formed from a compressible material and having a compressible lower wall supported by said base wall, and said bladder being supported by said cradle and having a tether, said tether comprising at least one strap;

a fluid delivery system configured to deliver fluid to said bladder;

a first group of said bladders arranged longitudinally along said cradle, a second group of said bladders arranged transversely along said cradle;

a third group of said bladders arranged longitudinally along said cradle beneath said second group of bladders, wherein said third group of said bladders comprises turning bladders; and wherein said at least one strap includes an anchor, said anchor being trapped between said compressible lower wall and said base wall.

13. A patient support apparatus comprising:

a support surface, said support surface including a plurality of fluid bladders, forming a bladder layer, and a base wall, a compressible member position between said bladders and said base wall;

said bladders being in a stacked arrangement over said compressible member, and said bladders having at least one tether extending from a medial portion of said bladder layer and through said compressible member and having an anchor trapped between said compressible member and said base wall;

a fluid delivery system including a pump configured to deliver fluid to said bladders; and at least a portion of said fluid delivery system being located in said support surface.

14. The patient support apparatus according to claim 13, wherein said support surface further includes a cradle formed from a compressible material and including said compressible member, said bladders supported on said compressible member in said cradle.

15. The patient support apparatus according to claim 14, wherein said cradle comprises a foam cradle.

16. The patient support apparatus according to claim 13, wherein a first group of said bladders is arranged longitudinally along said base wall, a second group of said bladders being arranged generally orthogonal to said first group of bladders transversely along said base wall, and each of said groups of bladders being tethered by said anchor.

17. The patient support apparatus according to claim 16, wherein a third group of said bladders comprises turning bladders.

18. The patient support apparatus according to claim 13, wherein said base wall includes a recess, said at least a portion of said fluid delivery system being located in said recess.

19. The patient support apparatus according to claim 13, wherein a first group of said bladders is arranged atop a second group of said bladders, and said tether extending through said second group of bladders and said compressible member to tether said first and second groups of bladders.

20. The patient support apparatus according to claim 13, wherein said at least a portion of said fluid delivery system is secured to said recess by a strap.

21. A patient support apparatus comprising:

a support surface, said support surface including a plurality of fluid bladders and a base wall;

a compressible member position between said bladders and said base wall;

said bladders being in a stacked arrangement over said compressible member, and said bladders having at least one tether and at least one anchor, said tether being coupled to said anchor;

a fluid delivery system including a pump configured to deliver fluid to said bladders;

at least a portion of said fluid delivery system being located in said support surface;

wherein said support surface further includes a cradle formed from a compressible material and including said compressible member, said bladders supported on said compressible member in said cradle; and wherein said tether extends through said cradle with said anchor trapped between said compressible member and said base wall.

22. The patient support apparatus according to claim 19, wherein said first group of said bladders are tethered by a plurality of straps, said straps extending through said second group of bladders to between said base wall and said compressible member to anchor said first and second groups of bladders.

23. The patient support apparatus according to claim 22, wherein said bladders include a third group of bladders, said straps extending through said second and third groups of bladders to between said base wall and said compressible member to anchor said first, second, and third groups of bladders.

24. The patient support apparatus according to claim 23, wherein said third group of bladders comprises at least two turning bladders.

* * * * *